US011825894B1

(12) United States Patent
Atkins et al.

(10) Patent No.: US 11,825,894 B1
(45) Date of Patent: Nov. 28, 2023

(54) REINFORCED HAND PROTECTOR

(71) Applicants: William H. Atkins, Chevy Chase, MD (US); Thomas W. Atkins, Chevy Chase, MD (US); Andrew B. Atkins, Chevy Chase, MD (US)

(72) Inventors: William H. Atkins, Chevy Chase, MD (US); Thomas W. Atkins, Chevy Chase, MD (US); Andrew B. Atkins, Chevy Chase, MD (US)

( * ) Notice: Subject to any disclaimer, the term of this patent is extended or adjusted under 35 U.S.C. 154(b) by 632 days.

(21) Appl. No.: 16/658,155

(22) Filed: Oct. 21, 2019

Related U.S. Application Data

(60) Provisional application No. 62/748,501, filed on Oct. 21, 2018.

(51) Int. Cl.
*A41D 19/015* (2006.01)

(52) U.S. Cl.
CPC ..... *A41D 19/01517* (2013.01)

(58) Field of Classification Search
CPC ..... A41D 19/01517; A41D 19/015; A41D 19/01588; A41D 13/087; A63B 71/14; A63B 2102/14; A61F 2005/0186
See application file for complete search history.

(56) References Cited

U.S. PATENT DOCUMENTS

| | | | | |
|---|---|---|---|---|
| 381,687 A | | 4/1888 | Fischer | |
| 1,377,338 A | | 5/1921 | Grinnell | |
| 1,388,618 A | * | 8/1921 | Stein | A41D 19/01517 2/21 |
| 1,509,801 A | * | 9/1924 | Walters | A41D 19/01588 2/19 |
| 1,951,190 A | * | 3/1934 | Gambee | D05B 91/04 2/21 |
| 2,538,837 A | | 1/1951 | Johnston | |
| 3,037,209 A | | 6/1962 | Applegate, Jr. et al. | |
| 3,564,614 A | | 2/1971 | Getchell et al. | |
| 3,882,548 A | | 5/1975 | Shinagawa et al. | |
| 4,094,014 A | | 6/1978 | Schroeder | |
| 4,272,849 A | * | 6/1981 | Thurston | A41D 19/01517 2/161.6 |
| 4,287,899 A | * | 9/1981 | Robichaud | A45D 29/22 132/73 |
| 4,355,424 A | | 10/1982 | McCoy, Jr. | |
| 4,405,681 A | | 9/1983 | McEvoy | |
| 4,411,024 A | | 10/1983 | Hayes | |
| 4,484,359 A | | 11/1984 | Tirinen | |
| 4,497,073 A | | 2/1985 | Deutsch | |
| D278,368 S | * | 4/1985 | Valentiner | D28/56 |

(Continued)

FOREIGN PATENT DOCUMENTS

| | | | | |
|---|---|---|---|---|
| CH | 686653 A5 | * | 5/1996 | A41D 19/01517 |
| WO | 03/013292 | | 2/2003 | |
| WO | 2007/103985 | | 9/2007 | |

*Primary Examiner* — Jillian K Pierorazio
(74) *Attorney, Agent, or Firm* — Pillsbury Winthrop Shaw Pittman, LLP; William P. Atkins

(57) ABSTRACT

A reinforced support device suitable for the protection of a hand and its digits from impacts, particularly those found in contact sports. The support device providing an outer skeleton and/or selected reinforcement portion(s), protects the digits of the hand and permits flexion of the fingers and/or thumb. The reinforcement portions can be of various shapes, sizes, materials, and weights. They may also be connected in various ways to one another.

15 Claims, 23 Drawing Sheets

(56) References Cited

U.S. PATENT DOCUMENTS 4,507,804 A 4/1985 Consigny
4,519,097 A 5/1985 Chappell, Jr. et al.
4,579,269 A 2/1986 Berlese
4,662,006 A 5/1987 Ross, Jr.
4,665,934 A * 5/1987 Jefferson ..... A45D 34/00 132/320
4,766,612 A * 8/1988 Patton, Sr. ..... A41D 19/01517 2/163
4,815,147 A 3/1989 Gazzano et al.
4,894,866 A 1/1990 Walker
4,894,868 A 1/1990 Christopher
4,930,162 A 6/1990 Cote
4,947,486 A 8/1990 Hsuih
4,984,300 A 1/1991 Cho
5,071,698 A 12/1991 Scheerder et al.
5,237,703 A 8/1993 Phippen
5,329,639 A 7/1994 Aoki
5,345,609 A 9/1994 Fabry et al.
5,459,883 A 10/1995 Garceau-Verbeck
5,488,739 A 2/1996 Cardinal
5,511,243 A 4/1996 Hall et al.
5,511,248 A 4/1996 Widdemer
5,548,844 A 8/1996 Ceresia
5,603,119 A 2/1997 Rinehart
5,613,507 A * 3/1997 Geer ..... A45D 31/00 132/73
5,664,260 A 9/1997 Weiser
5,699,816 A * 12/1997 Banes ..... A45D 29/00 132/73
5,745,916 A 5/1998 Linner
5,787,506 A 8/1998 Wilder et al.
5,884,329 A 3/1999 Goldsmith et al.
5,946,720 A 9/1999 Sauriol
5,974,588 A 11/1999 Furman
5,983,396 A 11/1999 Morrow et al.
5,996,117 A 12/1999 Goldsmith et al.
6,065,150 A 5/2000 Huang
6,085,354 A 7/2000 Wilder et al.
6,122,769 A 9/2000 Wilder et al.
6,154,882 A 12/2000 Ullman
6,209,137 B1 4/2001 Wallick
6,233,744 B1 5/2001 McDuff
D446,888 S 8/2001 Morrow
6,389,601 B2 5/2002 Kleinert
6,405,380 B1 6/2002 Kuroda et al.
D462,146 S 8/2002 Aoki
6,453,474 B2 9/2002 Kleinert
6,526,592 B1 3/2003 Best
6,543,057 B2 4/2003 Beland et al.
6,550,069 B1 4/2003 Morrow
6,584,615 B1 7/2003 Wilder
6,625,815 B2 9/2003 Litke
6,643,844 B2 11/2003 Morrow et al.
6,681,402 B1 1/2004 Bevier et al.
6,684,406 B2 2/2004 Fowler
6,701,530 B2 3/2004 Kleinert
6,799,333 B2 10/2004 Morrow et al.
6,813,780 B2 11/2004 Morrow
6,813,781 B2 * 11/2004 Wilder ..... A63B 71/148 2/163
6,959,453 B2 11/2005 Best
7,000,256 B2 2/2006 Kleinert
7,114,193 B2 10/2006 Winningham
7,117,540 B2 10/2006 Morrow
7,275,268 B2 10/2007 Gait
7,313,830 B2 1/2008 Desjardins et al.
7,313,831 B2 1/2008 Morhoip
7,318,241 B2 1/2008 Morrow
7,320,145 B2 1/2008 Hochmuth
7,363,846 B1 4/2008 Dean
7,370,373 B2 5/2008 Kohler
7,530,120 B2 5/2009 Morrow
7,574,748 B2 8/2009 Fisher
7,620,999 B2 8/2009 Fisher et al.
7,636,951 B2 12/2009 Morrow et al.
D608,978 S 2/2010 Votel
7,669,251 B2 3/2010 Hammons et al.
7,721,348 B2 5/2010 Nurnberg
7,774,860 B2 8/2010 Kohler
7,784,110 B2 8/2010 Jourde
7,797,758 B2 9/2010 Keppler
7,802,315 B2 9/2010 Contant
D626,696 S 11/2010 Winningham
7,836,521 B2 11/2010 Winningham
7,841,023 B2 11/2010 Winningham
D630,384 S 1/2011 Fream
7,861,321 B2 1/2011 Winningham
7,900,275 B2 3/2011 Morrow
D638,994 S 5/2011 Fream
7,937,774 B1 5/2011 King
7,979,918 B2 7/2011 Sandusky et al.
8,028,347 B2 10/2011 Chang
8,037,549 B2 10/2011 Sauer
8,060,949 B2 11/2011 Carcaterra
8,141,175 B2 5/2012 Saturnio
8,181,275 B2 5/2012 Saturnio
8,191,174 B2 6/2012 Winningham
8,201,272 B2 6/2012 Winningham
8,262,594 B2 9/2012 Sandusky et al.
8,312,562 B2 11/2012 Hammons et al.
8,341,763 B2 1/2013 Geyer
8,341,767 B2 1/2013 Winningham
8,479,318 B2 7/2013 Kim et al.
8,490,215 B2 7/2013 Mueller
8,510,863 B2 8/2013 Ferguson
8,516,612 B2 8/2013 Lynn
8,545,966 B2 10/2013 Vito et al.
8,719,963 B2 5/2014 Winningham
8,769,720 B2 7/2014 Aoki et al.
8,918,913 B2 12/2014 Power
8,966,663 B2 3/2015 Binge et al.
D728,164 S 4/2015 Smith
D728,166 S 4/2015 Binge et al.
9,241,519 B2 1/2016 Jaeger
9,249,274 B2 1/2016 Jaeger
D750,844 S 3/2016 Kohler et al.
D751,769 S 3/2016 McPhail
9,352,211 B2 5/2016 Aoki et al.
9,420,836 B1 8/2016 Madden, Jr.
9,504,900 B2 11/2016 Smith et al.
9,616,316 B2 4/2017 Smith et al.
9,802,104 B2 10/2017 Cox
9,802,105 B2 10/2017 Binge et al.
9,839,831 B2 12/2017 Brown et al.
9,861,876 B2 1/2018 Vito et al.
D818,202 S 5/2018 McPhail
9,968,144 B2 5/2018 McPhail
2003/0014805 A1 1/2003 Morrow et al.
2003/0192104 A1 * 10/2003 Wilder ..... A41D 19/01588 2/161.1
2003/0208833 A1 11/2003 Gold
2004/0010834 A1 1/2004 Sidlo
2004/0060096 A1 4/2004 Thiruppathi
2004/0093656 A1 5/2004 Morrow et al.
2004/0123372 A1 7/2004 Kleinert
2004/0261155 A1 12/2004 Agathos
2005/0114982 A1 * 6/2005 Gremmert ..... A41D 19/01517 2/159
2005/0114984 A1 6/2005 Morrow
2005/0251893 A1 11/2005 Hayden
2006/0107432 A1 5/2006 Cicero
2006/0195967 A1 9/2006 Kohler
2007/0261149 A1 11/2007 Gait
2007/0277288 A1 12/2007 Sing et al.
2008/0034469 A1 2/2008 Beland
2008/0083048 A1 4/2008 Morrow et al.
2008/0086789 A1 * 4/2008 Dick ..... A41D 13/06 2/2.5
2008/0104737 A1 5/2008 Shepherd
2008/0146981 A1 6/2008 Greenwald et al.
2008/0178359 A1 7/2008 Grilliot et al.
2008/0196135 A1 * 8/2008 Gait ..... A41D 19/01588 2/21

(56) References Cited

U.S. PATENT DOCUMENTS

| | | | | |
|---|---|---|---|---|
| 2008/0244799 | A1 | 10/2008 | Winningham | |
| 2008/0263747 | A1 | 10/2008 | DeBlasis | |
| 2008/0313786 | A1* | 12/2008 | Saturnio | A41D 19/01588 2/163 |
| 2009/0019613 | A1 | 1/2009 | Carcaterra et al. | |
| 2009/0044306 | A1 | 2/2009 | Lamson et al. | |
| 2009/0077714 | A1 | 3/2009 | Baacke | |
| 2009/0165185 | A1* | 7/2009 | Contant | A63B 71/143 2/163 |
| 2009/0172864 | A1* | 7/2009 | Fisher | A63B 71/148 2/163 |
| 2009/0222967 | A1* | 9/2009 | Winningham | A41D 13/05 2/21 |
| 2009/0271913 | A1* | 11/2009 | Fisher | A41D 19/01588 2/163 |
| 2010/0031603 | A1 | 2/2010 | Letts | |
| 2010/0281599 | A1 | 11/2010 | Fiegener | |
| 2011/0067165 | A1 | 3/2011 | Fream et al. | |
| 2011/0126342 | A1 | 6/2011 | Bautista | |
| 2012/0030856 | A1 | 2/2012 | Bevier | |
| 2012/0054937 | A1 | 3/2012 | Robaire | |
| 2012/0131716 | A1 | 5/2012 | Copeland | |
| 2012/0284892 | A1* | 11/2012 | Szurley | A63B 71/143 2/16 |
| 2014/0201880 | A1 | 7/2014 | Binge | |
| 2015/0033432 | A1* | 2/2015 | Cox | A63B 71/143 2/16 |
| 2016/0375343 | A1* | 12/2016 | Woodhead | A63B 71/143 2/16 |
| 2017/0173441 | A1* | 6/2017 | Lemieux | A63B 71/143 |
| 2019/0328062 | A1* | 10/2019 | Kamphuis | A41D 19/01588 |

* cited by examiner

REINFORCED HAND PROTECTOR

CROSS-REFERENCE TO PRIOR APPLICATION

This application claims the benefit of U.S. provision patent application 62/748,501 filed Oct. 21, 2018.

BACKGROUND

Field

Among other things the present application is generally related to a reinforced support device and discloses improvements for protecting a hand and digits from impacts, particularly those found in contact sports or sports involved in throwing or hitting an object. More specifically, the disclosure relates to a reinforced hand protector for protecting a hand's digits, dorsal or palmar region, or all, as well as the wrist and even forearm.

Background

Injuries to the hand and wrist account for many injuries seen in emergency departments. As such, organizations such as the National Collegiate Athletic Association or NCAA require that players use protective equipment for contact sports, such as lacrosse and hockey.

The NCAA's Men's Lacrosse 2017 and 2018 Rules and Interpretations; 2015 and 2016 Men's Lacrosse Rules and Interpretations; 2013 and 2014 Men's Lacrosse Rules and Interpretations (Updated February 2014)(collectively "Lacrosse Rules", can be found on the NCAA.org website, and are incorporated herein by reference), require protective equipment in order to play lacrosse in a college setting. Section 21 of the most recent NCAA Lacrosse Rules states that "[a]ll players shall wear protective gloves, shoes, and jerseys." Section 23 of the same Lacrosse Rules states that "[n]o player shall wear or carry equipment that, in the opinion of the officials, endangers that individual or other players."

The NCAA's Men's Hockey 2018-19 and 2019-20 Ice Hockey Rules & Interpretations; 2016-17 and 2017-18 NCAA Ice Hockey Rules & Interpretations; 2014-15 and 2015-16 NCAA Ice Hockey Rules and Interpretations (Due late Fall 2014); and 2012-13 and 2013-14 NCAA Ice Hockey Rules and Interpretations (Due September 2012) (collectively "Hockey Rules", can also be found on the NCAA.org website, and are incorporated herein by reference) also require protective equipment in order to play hockey in a college setting.

Protective equipment is particularly useful given the dangers associated with sports and other similar activities. For example, the National Operating Committee on Standards for Athletic Equipment in their Standard Performance Specification for Newly Manufactured Lacrosse Balls requires that the ball be "within 5.0 to 5.25 oz." These lacrosse balls can reach speeds over 100 mph. Likewise, airborne hockey pucks can travel at upwards of 80-90 mph. Impacts to the hand at speeds such as these can cause serious injury.

As described in Taber's Cyclopedic Medical Dictionary, 9th ed., incorporated herein by reference, a typical hand is comprised of "the wrist (ossa carpi), with its 8 bones, the metacarpus, or body of the hand (ossa metacarpalia), having 5 bones, and the phalanges (fingers [and thumb]) with their 14 bones." As described in Gray's Anatomy, 38th ed., incorporated herein by reference, the fingers contain three bones connected by cartilage: the proximal phalanx, the middle phalanx, and the distal phalanx. Similarly, the thumb contains two bones connected by cartilage: the proximal phalanx and the distal phalanx. In addition, the hand has both a dorsal region and a palmar region. The dorsal region is the typically referred to as the posterior of the hand and the palmar region is typically referred to as the anterior of the hand, opposite the dorsal region.

As described in Black's Medical Dictionary, 35th ed., incorporated herein by reference, the metacarpal bones connect the bones in the fingers and thumb to the bones in the wrist. The head of the metacarpal bone is the end closest to the fingers or thumb, and the base of the metacarpal bone is the end closes to the wrist.

As described in Punch Injuries: Insights into Intentional Closed first Injuries, Western Journal of Emergency Medicine, Volume XII, No. 1 (February 2011), incorporated herein by reference, impacts to the dorsal part of the hand may break the underlying bones, particularly, the shafts of the metacarpal bones. In addition, if the hand is closed, impacts near the head of a metacarpal bone may also cause what are often called a boxer's fracture or injuries to the proximal phalanx of the fingers. In addition, Black's Medical Dictionary describes the skin of the hand as being "richly supplied with nerve filaments." These nerve filaments may also be damaged by impacts to the hand and its digits.

SUMMARY

According to an embodiment, a reinforced hand protector includes a main body with a plurality of digit portions extending from the main body and forming a digit-reinforcing skeleton including at least one section for a digit portion, wherein a digit-reinforcing skeleton defines an arcuate shell with a plurality of edges which may or may not wrap around a portion of the end of the digit and may or may not be connected to a digit or dorsal or palmar portion.

Other features and advantages of the present inventions will become apparent from the following detailed description, the accompanying drawings, and the appended claims.

BRIEF DESCRIPTION OF THE DRAWINGS

Examples will now be described, by way of example only, with reference to the accompanying drawing in which corresponding reference symbols indicate corresponding parts, and in which.

DETAILED DESCRIPTION OF THE ILLUSTRATED EMBODIMENTS

Figure 1:
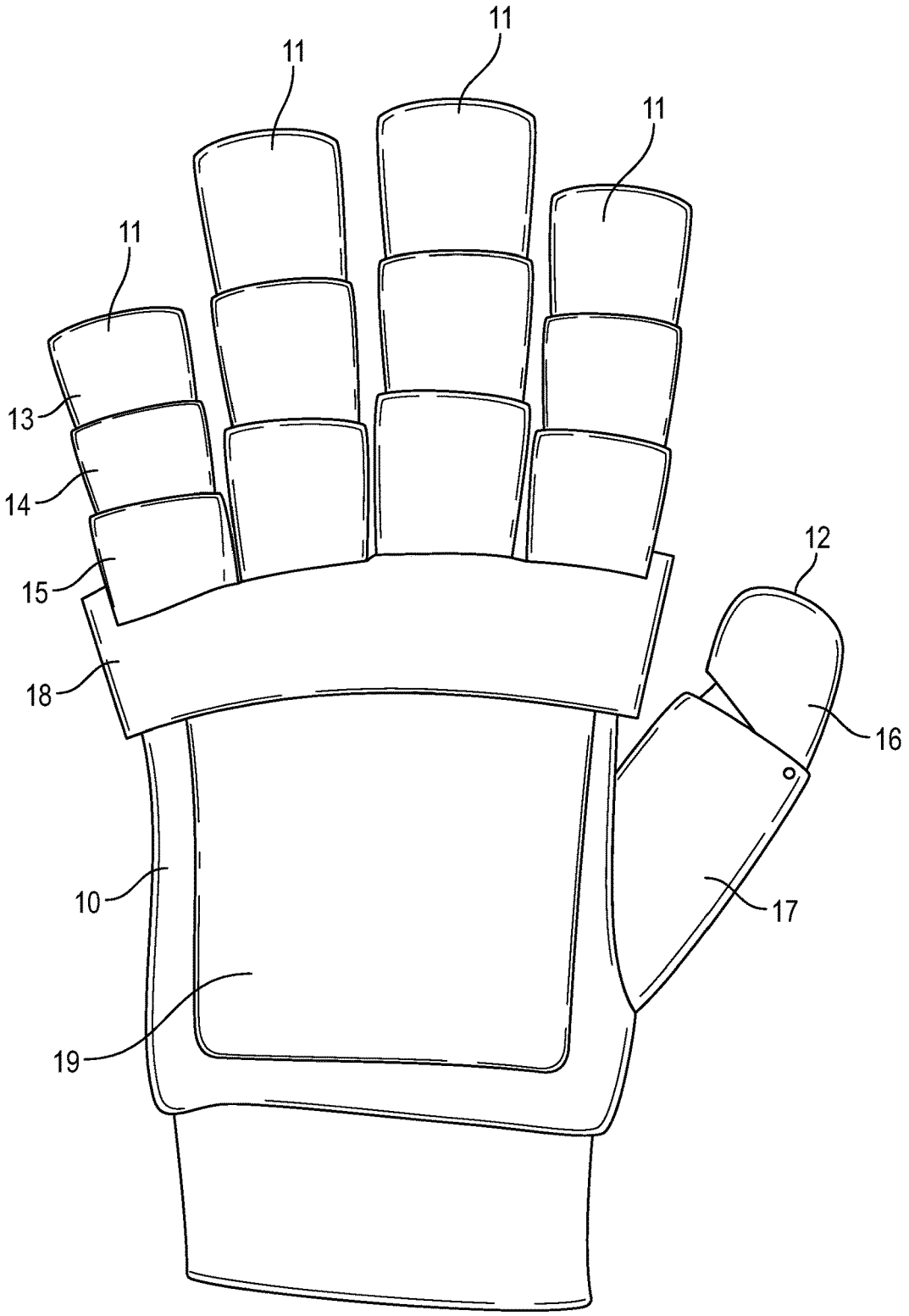
FIG. 1 illustrates a dorsal view of an embodiment of a reinforced hand protector.

It should be understood at the outset that, although exemplary embodiments are illustrated in the figures and described herein, the principles of the present disclosure may be implemented using any number of materials, shapes, connections, or attachments. The present disclosure should in no way be limited to the exemplary implementations and techniques illustrated in the drawings and described herein. For example, exemplary implementations are illustrated for fingers and thumbs, however they may be interchanged for use on any digit or portion thereof, be it a thumb, forefinger, or any finger, either individually or in combination. Exemplary implementations are illustrated and described for dorsal and/or palmar regions or portions of them and they too may also be interchanged for use on any portion thereof, either individually or in combination, as well as being connected to digit portions. Furthermore, such exemplary illustrations and descriptions should be understood to be able to be implemented directly on the hand, including its digit(s), dorsal, or palmar regions, directly above the hand, inside an article covering at least a portion of a hand (at any depth), or on the exterior of such an article covering at least a portion of a hand, and, of course, in any combination of such implementation. Note that items illustrated in the drawings are not necessarily drawn to scale unless otherwise noted.

It is to be understood that the use of absolute terms, such as "must," "will," and the like, as well as specific quantities, should be construed as being applicable to one or more of such embodiments, but not necessarily to all such embodiments. As such, embodiments may omit or include a modification of one or more features, portions, connections, or functionalities described in the context of such absolute terms.

FIG. 1 illustrates a dorsal view of an embodiment of a reinforced hand protector. This embodiment includes a main body 10, finger portions 11, and thumb portion 12. A finger portion 11 may be attached to a finger-reinforcing portion which may include a distal phalanx portion 13, middle phalanx portion 14, and/or proximal phalanx portion 15. Each portion, such as the proximal phalanx portion 15, may also be attached to knuckle protector 18, which may also or alternatively be attached to a main body 10 or a dorsal region portion 19. Similarly, thumb portion 12 may be attached to a distal phalanx portion 16 and proximal phalanx portion 17. Each digit portion may alternatively be attached to a main body 10 and/or a dorsal region portion 19. The digit portions may be attached together as well and this may connect them at the more dorsal region or anywhere else near the side of a digit. The main body 10 may also be attached to dorsal region portion 19. The digit and/or dorsal region portions and knuckle protector may be made of a rigid and/or shock absorbing material or combination of them. Such materials may include, but not be limited to, metal, plastic, rubber, fabrics, gel packs, woven solids, foam rubber, or other materials.

Figure 2:
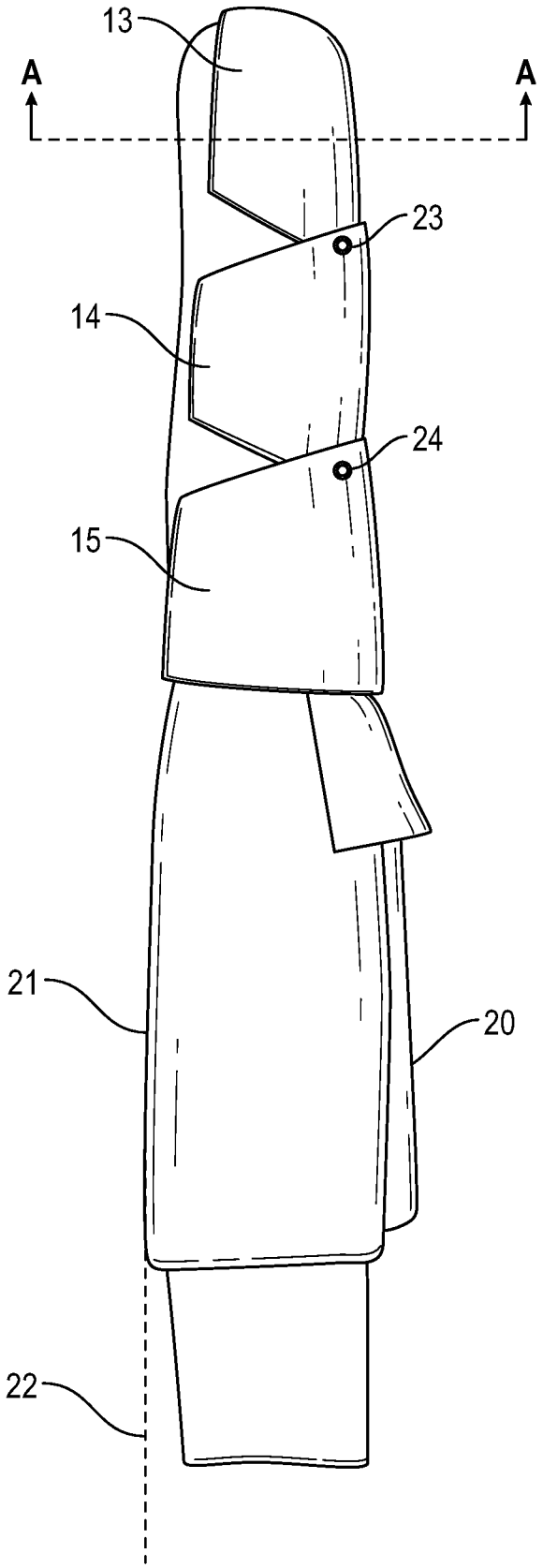
FIG. 2 illustrates a side view of an embodiment of a reinforced digit protector.

FIG. 2 illustrates a side view of an embodiment of a digit protector. The interior and/or exterior of the digit protector may be combined, connected or attached to, or coincide with virtually any material and/or surface treatment. For example, one embodiment could have an interior foam layer which may be with combined with a plastic or leather layer forming the digit protector. While another embodiment may have a metal or plastic layer combined with an outer foam layer, both of which form a portion of the digit protector. A digit protector may contain dorsal region portion 20 and/or a palmar region portion 21. In another embodiment, the palmar region portion 21 may be coplanar with a palmar plane 22. Attachment 23 may connect distal phalanx portion 13 and middle phalanx portion 14. Attachment 24 may also and alternatively connect middle phalanx portion 14 and proximal phalanx portion 15. Attachments 23 and 24 preferably allow a user to move a digit, even slightly, and preferably without substantially decreasing the reinforcement.

Figure 3:
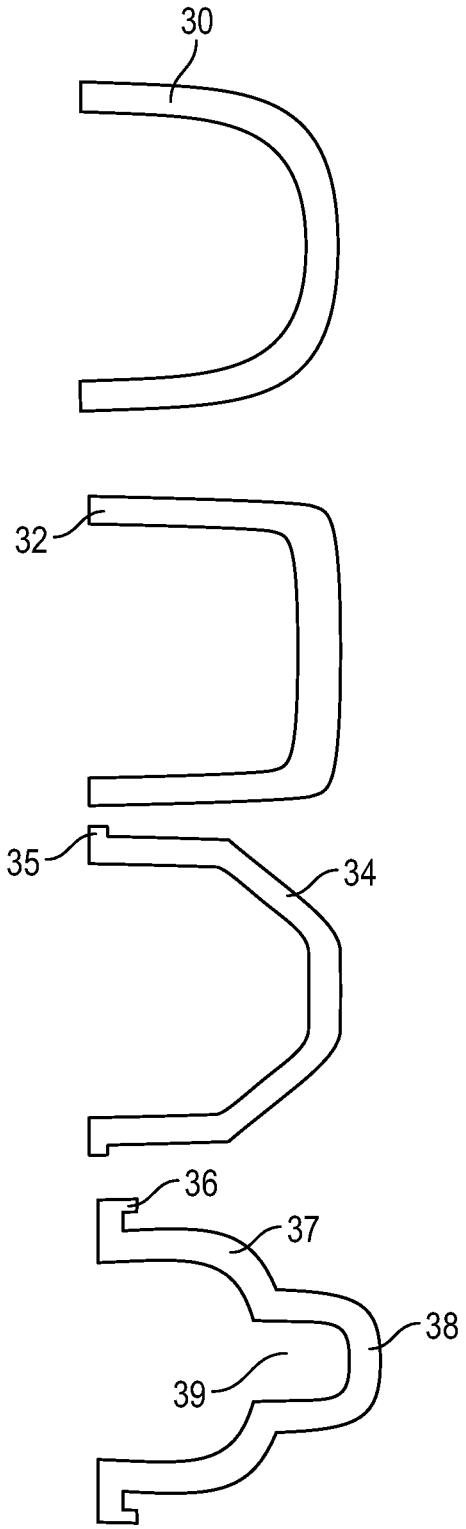
FIG. 3 illustrates a cross-sectional view along line A-A of FIG. 2 with various embodiments.

FIG. 3 illustrates a cross-sectional view along line A-A of FIG. 2 but may also represent the shapes of any digit portions. The arcuate shaping could allow an impact to be distributed throughout the digit protector and even transmitted onto an underlying stick. Embodiments could include, but not be limited to, a curvature 30, a generally square or rectangular shape 32, a multi-sided shape 34 which may alternatively include one or more feet 35, a multi-curved shape 39 with curves 37 and 38 which may alternatively comprise a foot with an upward portion 36. It is to be understood that one can combine such shapes in a myriad of ways, on one or more digits, with and without one or more feet, and with or without an upward portion. It is to also be understood that, while illustrated in one way, the shapes can form a ring-like portion an employed in a fashion similar to one shown in FIG. 23.

Figure 4:
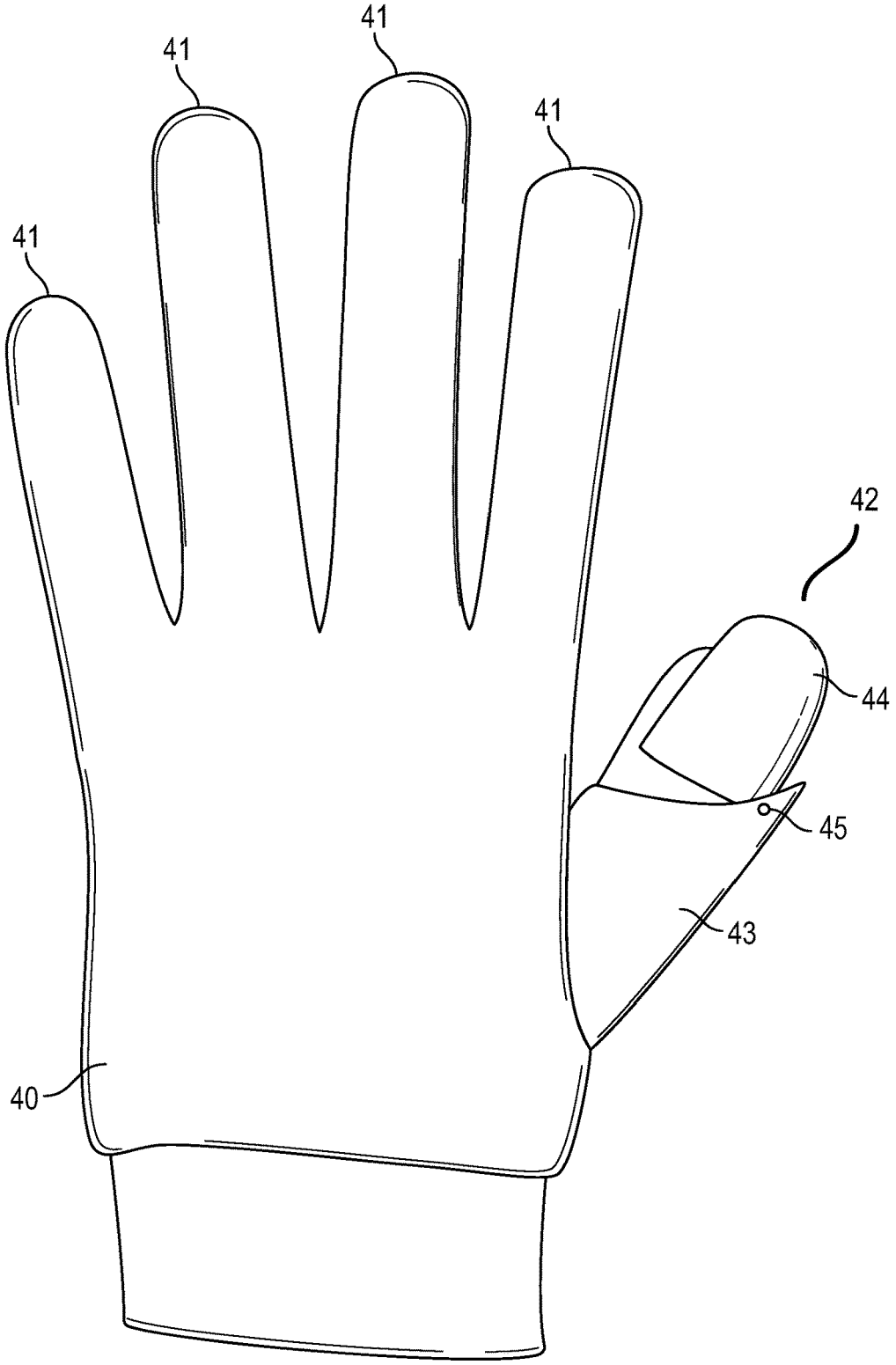
FIG. 4 illustrates a perspective view of an embodiment of a reinforced hand protector.
Figure 5:
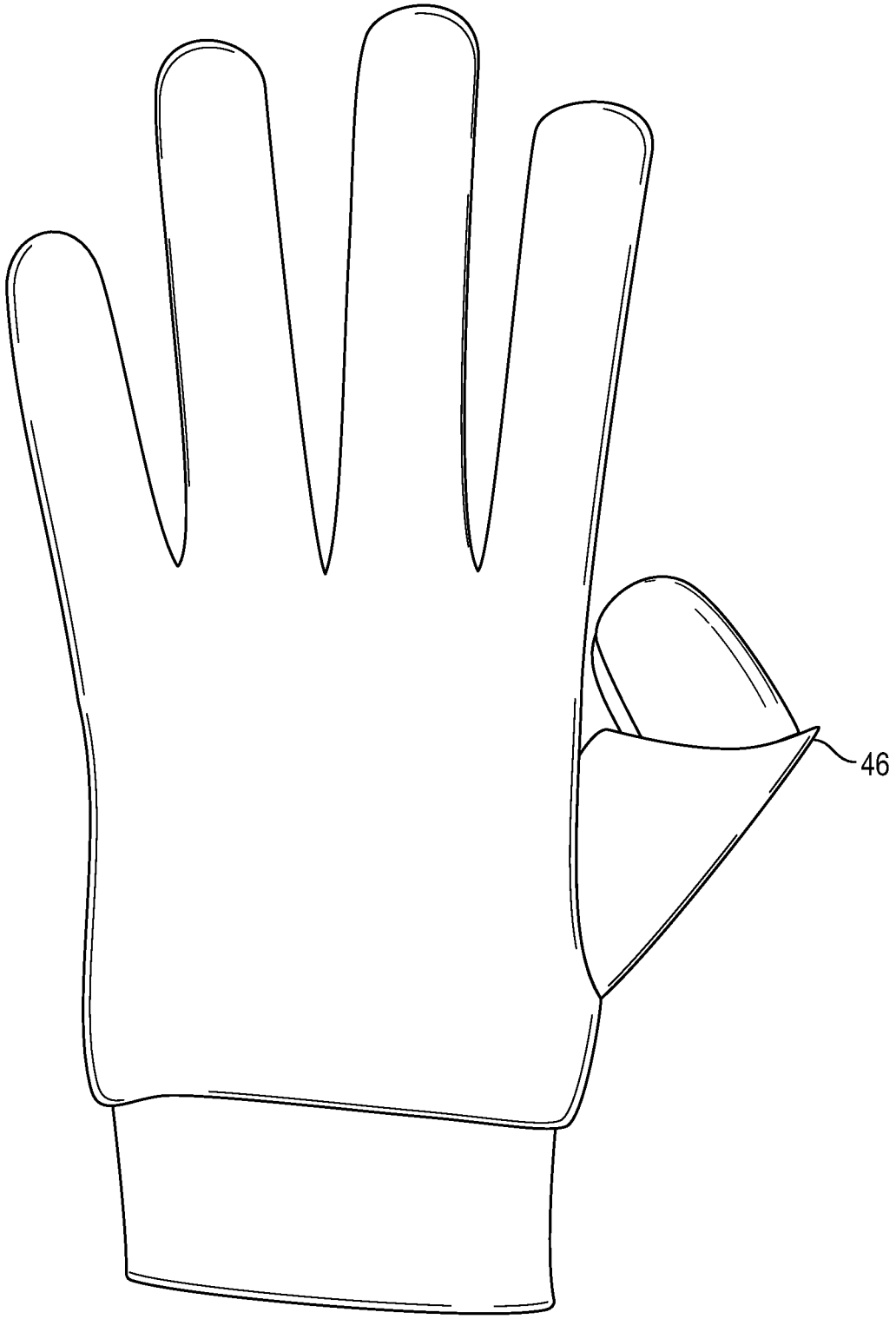
FIG. 5 illustrates a different view of the reinforced hand protector of FIG. 4.

FIG. 4 illustrates a perspective view of an embodiment of a reinforced hand protector. This preferably includes a main body 40, finger portions 41 and thumb portion 42. Thumb portion 42 preferably includes proximal phalanx section 43 and distal phalanx section 44. Proximal phalanx portion 43 and distal phalanx section 44 are preferably connected by attachment 45. FIG. 4 illustrates when a thumb is straighter, while FIG. 5 illustrates a thumb being bent and without a visible attachment. While in the closed position, end portion 46 preferably protects a thumb from impact, preferably to the end of a thumb's proximal phalanx. Such an end portion can be comprised in many different shapes and need not be as sharply pointed as illustrated. For example, the end portion could be thicker, come to a point, leave a small gap between distal phalanx portion 44 and proximate phalanx portion 43, or coincide with the approximate arc of the distal phalanx portion 44 as that section rotates or moves.

Figure 6:
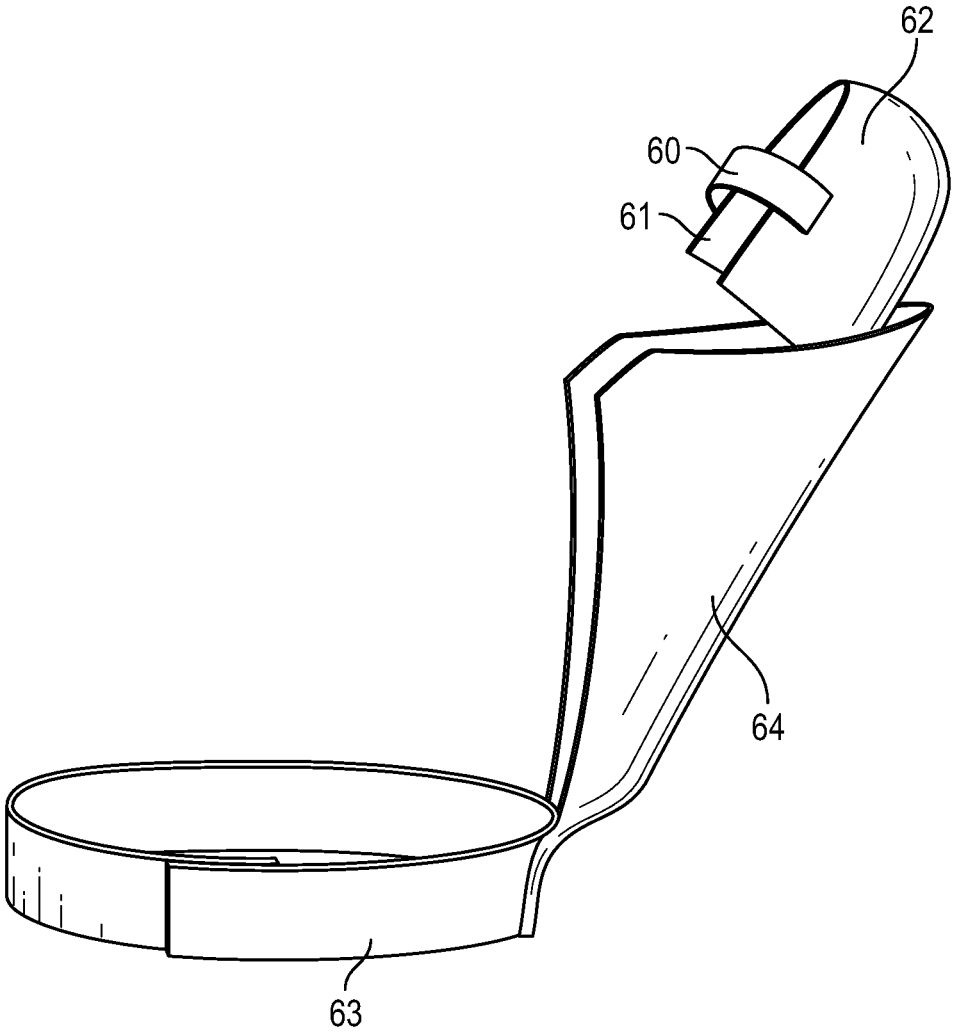
FIG. 6 illustrates a perspective view of a reinforced digit protector.

FIG. 6 illustrates a perspective view of a reinforced digit protector. This embodiment can operate as an addition to a preexisting glove or as a standalone unit or be incorporated into a hand protector or glove. The reinforced digit protector disclosed in FIG. 6 is similar to the item illustrated in FIG. 4, but different. It may include a closing 60 which may secure a first region 61 and second region 62 around a digit or alternatively, the digit portion of a preexisting glove or hand protector. Closing 60 may be comprised of hook-and-loop, drawstrings, elastic, pressure fitting, rivets, glue, or other ways of securing or attaching either 60 to the first region 61 and second region 62 or alternatively to a preexisting glove or hand protector. Another embodiment may have attachment 63 attached to proximal phalanx section 64, both of which may be of many differing shapes or forms or material as they would need to be attached. Attachment 63 could surround a wrist, forearm, or a wrist portion of a preexisting glove or hand protector and may be comprised of hook-and-loop fasteners, drawstrings, elastic, pressure fitting, rivets, glue, or other ways of securing or attaching.

Figure 7:
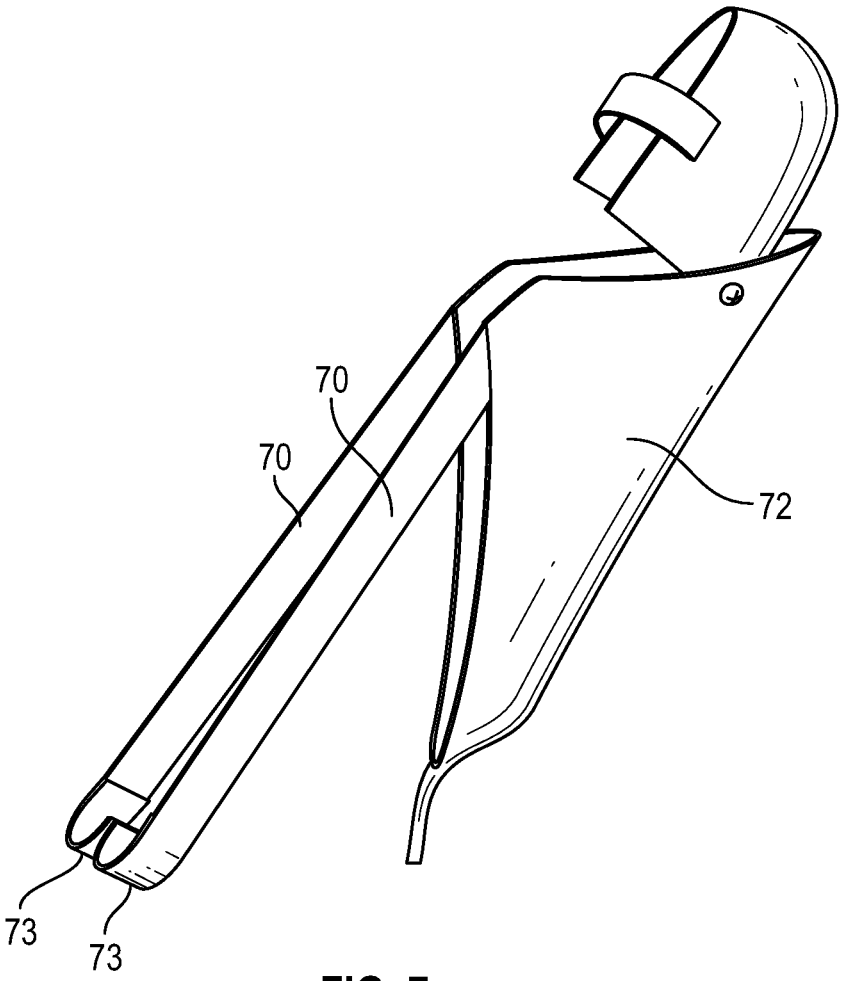
FIG. 7 illustrates a dorsal view of an embodiment of a reinforced hand protector.

FIG. 7 illustrates a perspective view of an embodiment of a reinforced hand protector. This embodiment is similar to the embodiment disclosed in FIG. 6, but instead of a wrist strap, the connector attachment includes attachment 73. Connector 70 is attached to proximal phalanx section 72 and includes attachment 73 which may attach to a preexisting glove.

Figure 8:
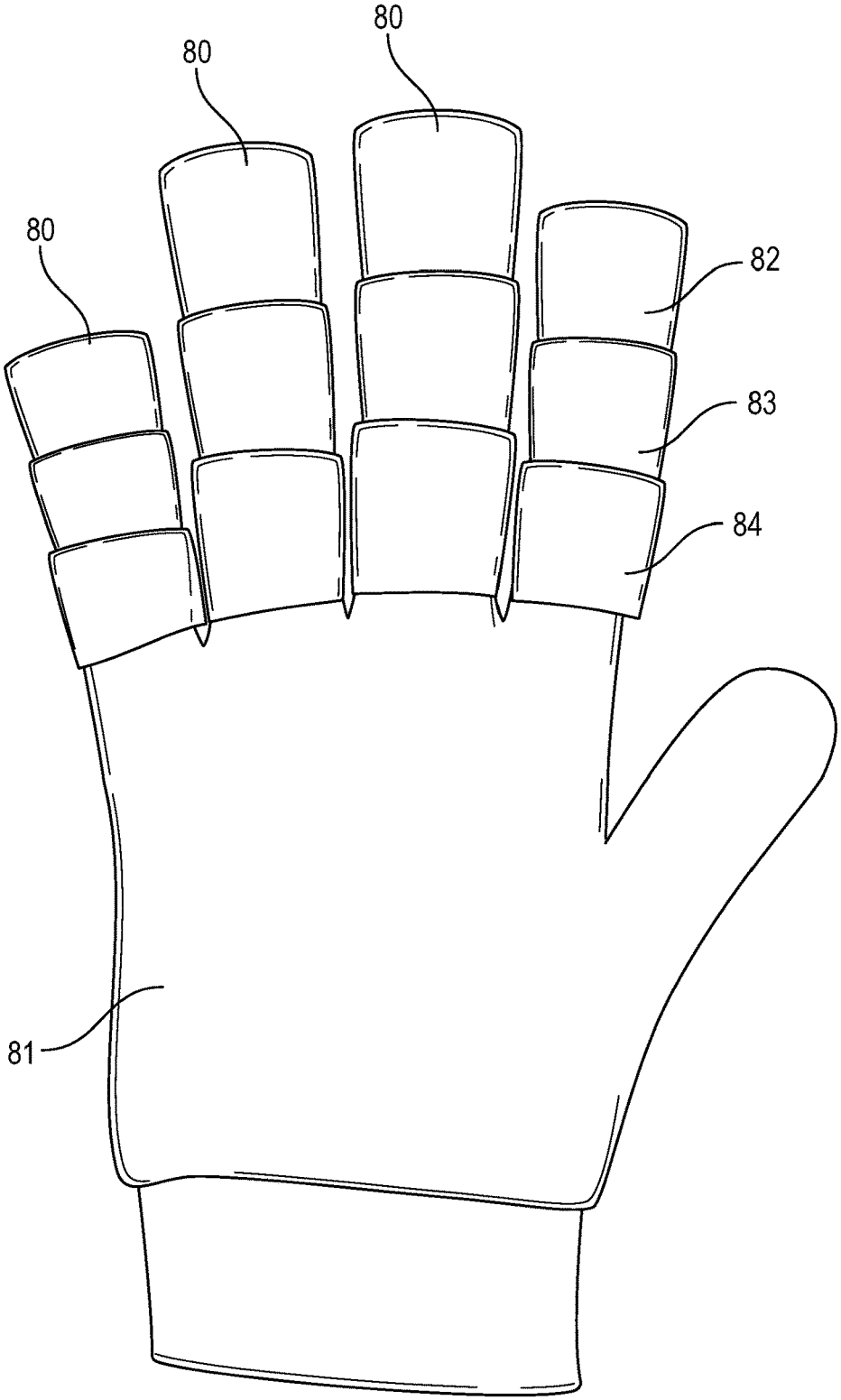
FIG. 8 illustrates a dorsal view of an embodiment of a reinforced hand protector.

FIG. 8 illustrates a perspective view of an embodiment of a reinforced hand protector. This embodiment includes digit protector 80 attached to glove 81. The distal 82, middle 83, and proximate 84 portions are illustrated on each digit but not the thumb. In another embodiment, one or more digit protectors may preferably be attached to glove 81 by various fastening means including adhesive, hook and loop, mechanical, pressure, or by shaping the digit protector to wrap partially or fully around the digit.

Figure 9:
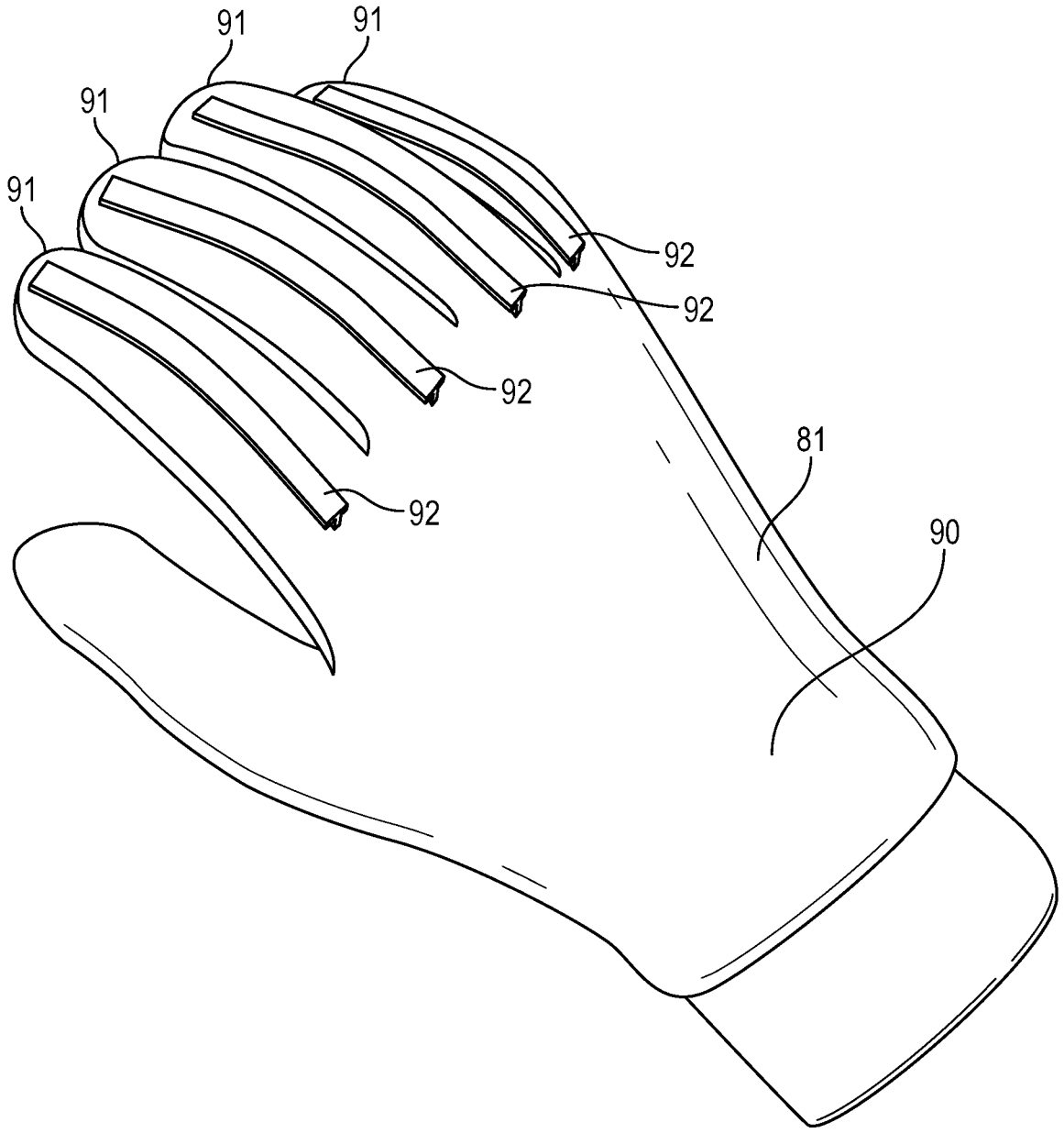
FIG. 9 illustrates a dorsal view of the reinforced hand protector of FIG. 8.

FIG. 9 illustrates a perspective view of another embodiment of a reinforced hand protector. Glove 81 includes main body 90 and digit portions 91. Digit portion 91 may include one or more mounting rails 92. Although not illustrated, a thumb may also and alternatively individually include a mounting rail.

Figure 10:
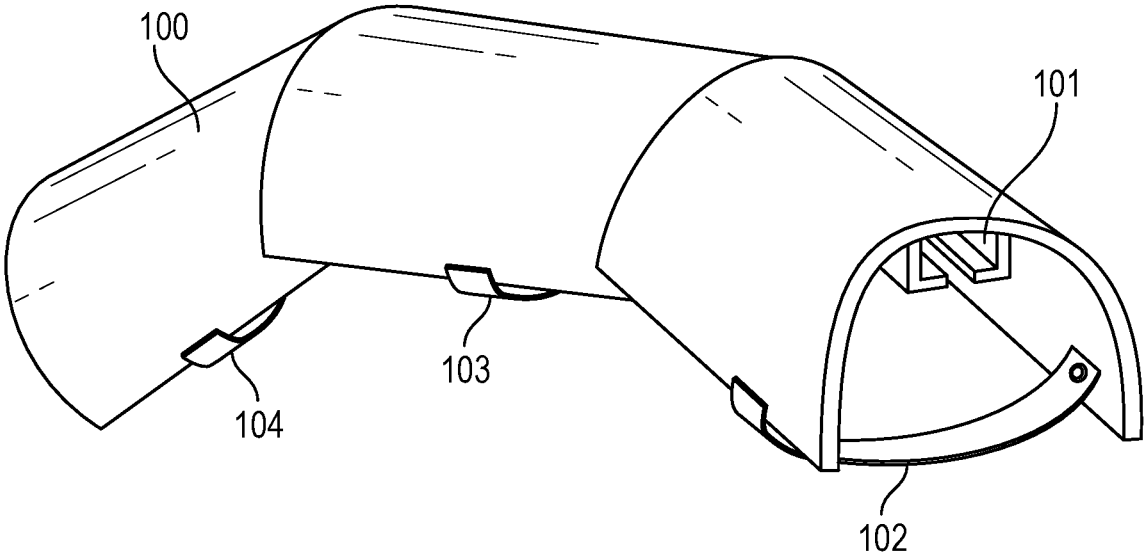
FIG. 10 illustrates a perspective view of the reinforced hand protector of FIG. 8.

FIG. 10 illustrates a perspective view of a digit protector 100. Digit protector 100 includes mounting-rail attachment 101 and attachments 102, 103, and 104. Mounting-rail attachment 101 may be located on an inner portion of digit protector 80 and may interface with a device such as mounting rail 92 illustrated in FIG. 9. A single, such as 102, or multiple attachments may be connected to one or both sides of a digital portion and may alternatively have a hook and loop or other means of attaching to the underlying digit or glove. In another embodiment, a mounting rail attachment on a single portion of a digit can be sufficient to attach a digit protector 100.

Figure 11:
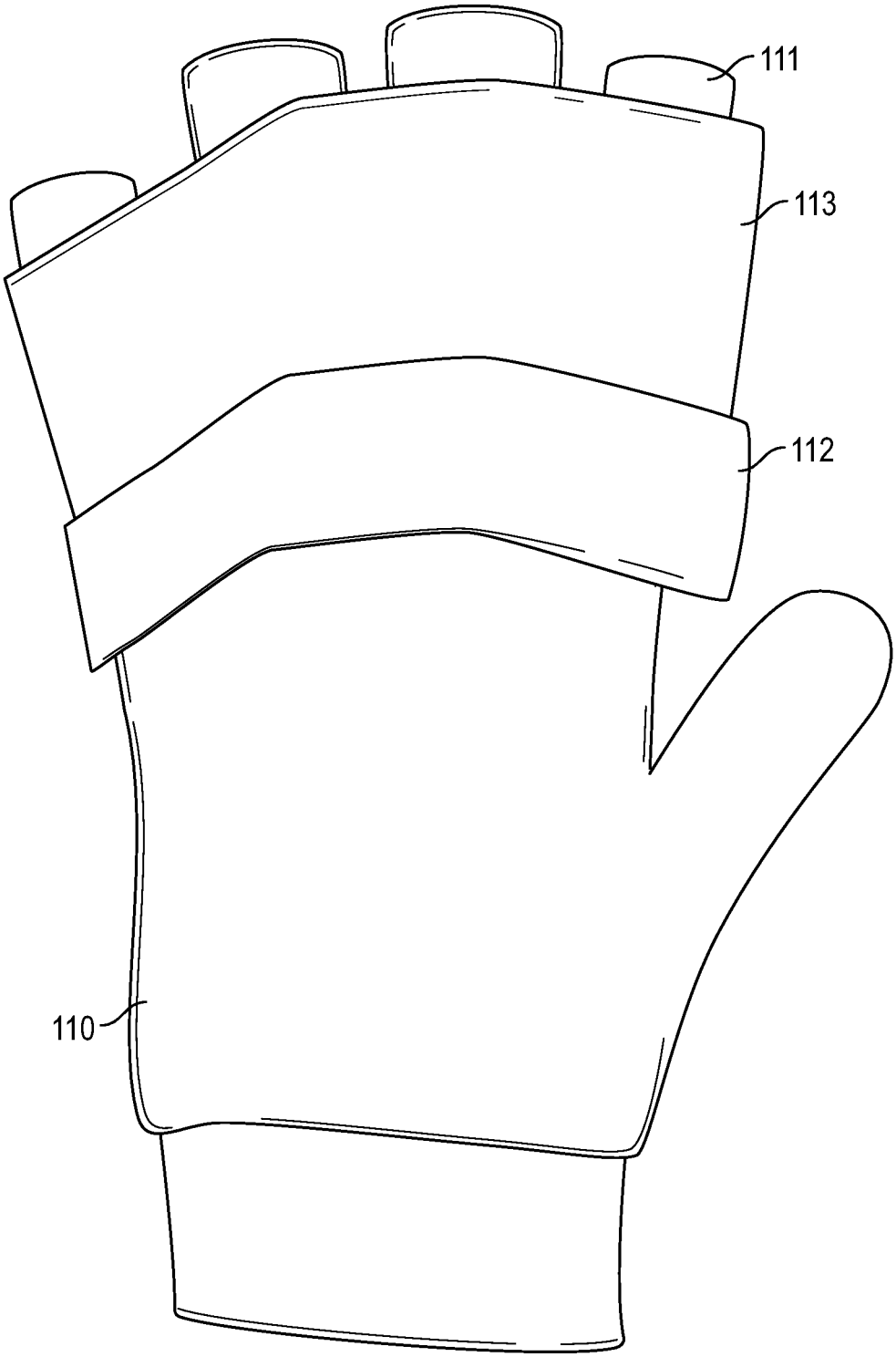
FIG. 11 illustrates a perspective view of a reinforced hand protector.

FIG. 11 illustrates a perspective view of a reinforced hand protector. This embodiment includes main body 110 and finger portion 111. Finger portion 111 is attached to main body 110 and includes proximal phalanx section 112 and middle phalanx section 113. As disclosed in FIG. 11, middle phalanx section 113 can also extend further to protect the distal phalanx portion of a hand while proximal phalanx section 112 can extend further to protect the knuckle or dorsal regions. The proximal phalanx section 112 and middle phalanx section 113 may be connected to one another in one embodiment while connected to the finger portion 111 or alternatively the main body 110.

Figure 12:
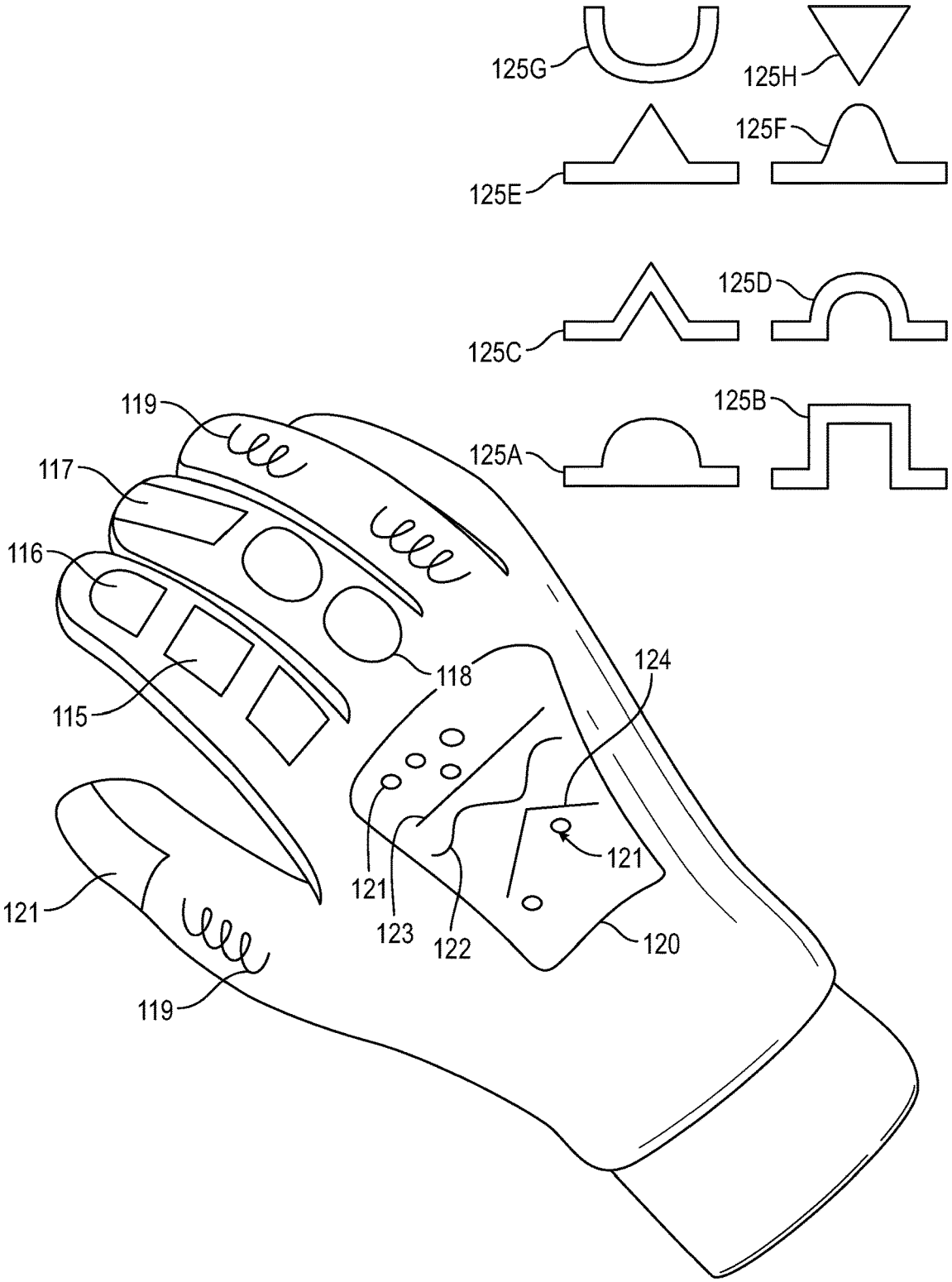
FIG. 12 illustrates various materials, physical designs, or appropriate strengthening fabrics on a reinforced hand protector.

FIG. 12 illustrates various embodiments which may be employed in the digit, dorsal, or palmar portions. One embodiment may use materials for a distal thumb portion 121 which in turn may cover a portion of a thumb and/or may also wrap around one or more sides of a thumb and/or may also wrap around the tip of a thumb. A similar but not identical embodiment is shown as distal finger portion 117 which may also protect a finger as does distal thumb portion 121. The distal 116, middle 115, and proximal 118 finger portions may cover a portion of the dorsal region of a finger and/or may also wrap around one or more sides of a finger and/or for the distal finger portions. Some embodiments may also wrap around the tip of a finger, such as distal finger portions 116 and 117. In addition to those illustrated in FIG. 12, the various digit (finger or thumb) portions may be of various shapes and sizes. For example, FIG. 12 illustrates portion 118 as being substantially round or oval, while portion 117 is somewhat rectangular, portion 115 is substantially square, portion 116 is substantially arched or curved on at least one side. In another embodiment, a spring 119, may be used to reinforce and/or protect at least a portion of one digit. A spring 119 may be a compression, extension, torsion, and/or constant force spring and may also alternatively be of a flattened, oval, round, square, triangular, or oblong shape, as well as any other suitable shape. These reinforcing items may alternatively be located inside, within, or outside a hand protecting device and combined with various materials and/or surface treatments. FIG. 12 also illustrates a dorsal region portion 120 with various features including holes or detents or dimples 121, a curved ridge 122, a straight ridge 123, and a V-shaped ridge 124. The digit or dorsal portions may employ such features as those shown in cross section with substantially a rounded shape 125A, square shape 125B, an inverted V shape 125C, an inverted U-shape 125D, an inverted V shape 125E, and inverted oval or round shape 125F, a more hollow U-shape 125G, and triangular shape 125H. These treatments may be used individually or in any combination and not just on the dorsal region portion but also alternatively on the digits and may be used on a palmar region as well.

Figure 13:
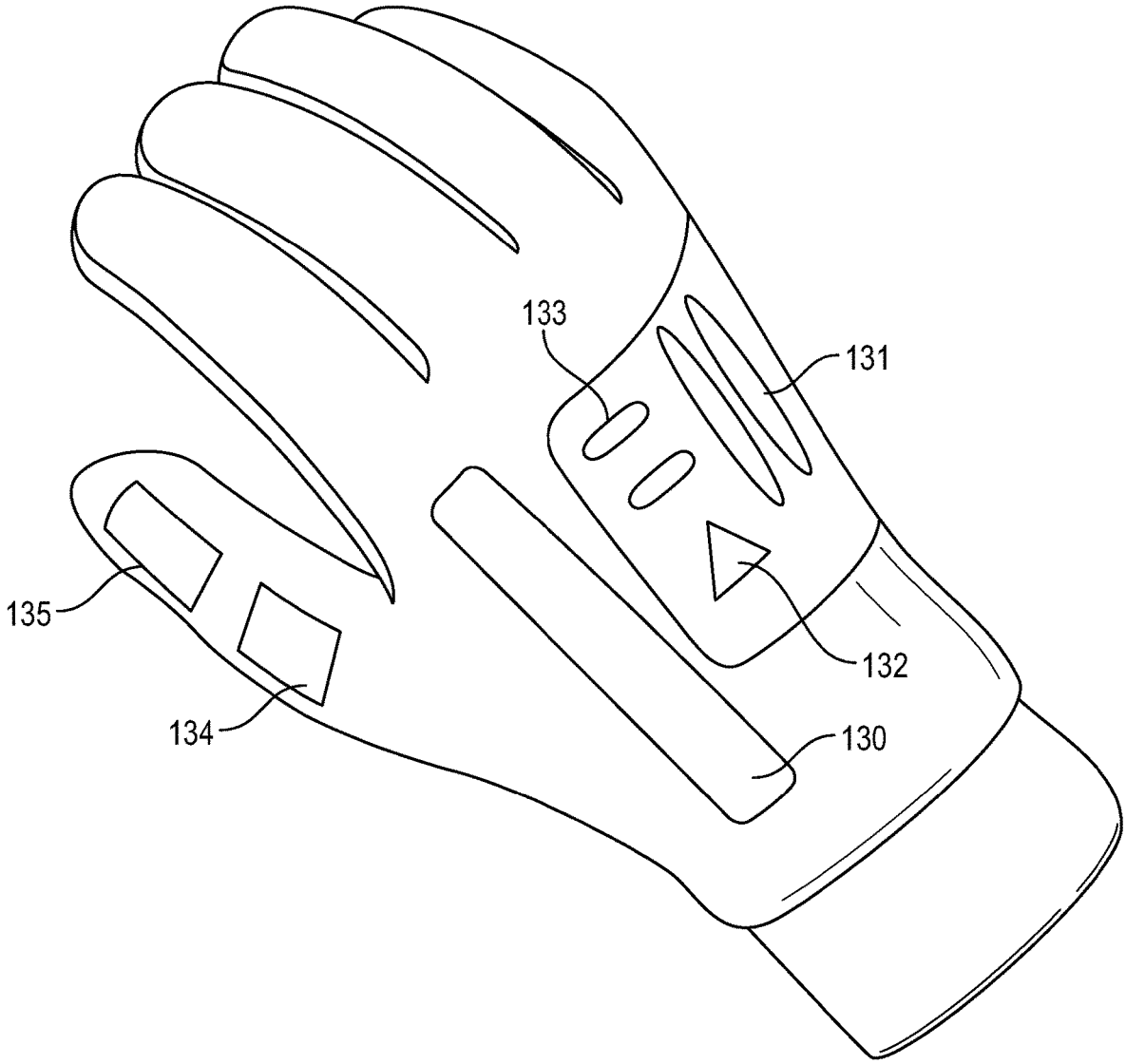
FIG. 13 illustrates various shapes of portions to be used on a reinforced hand protector.

FIG. 13 illustrates embodiments which may be used individually or in any combination and not just on the dorsal region portion but also alternatively on a digit and may be used on a palmar region as well. The various embodiments may employ a substantially triangular slot 132, a substantially vertical slot 131, and/or a substantially horizontal slot 133. The dorsal portion may be comprised of first and second materials. Also shown in FIG. 13 is a dorsal protective strip 130 and two protective thumb portions 134 and 135. This dorsal protective strip 130 may preferably align with the underlying bone structure as would the two thumb portions 134 and 135.

Figure 14:
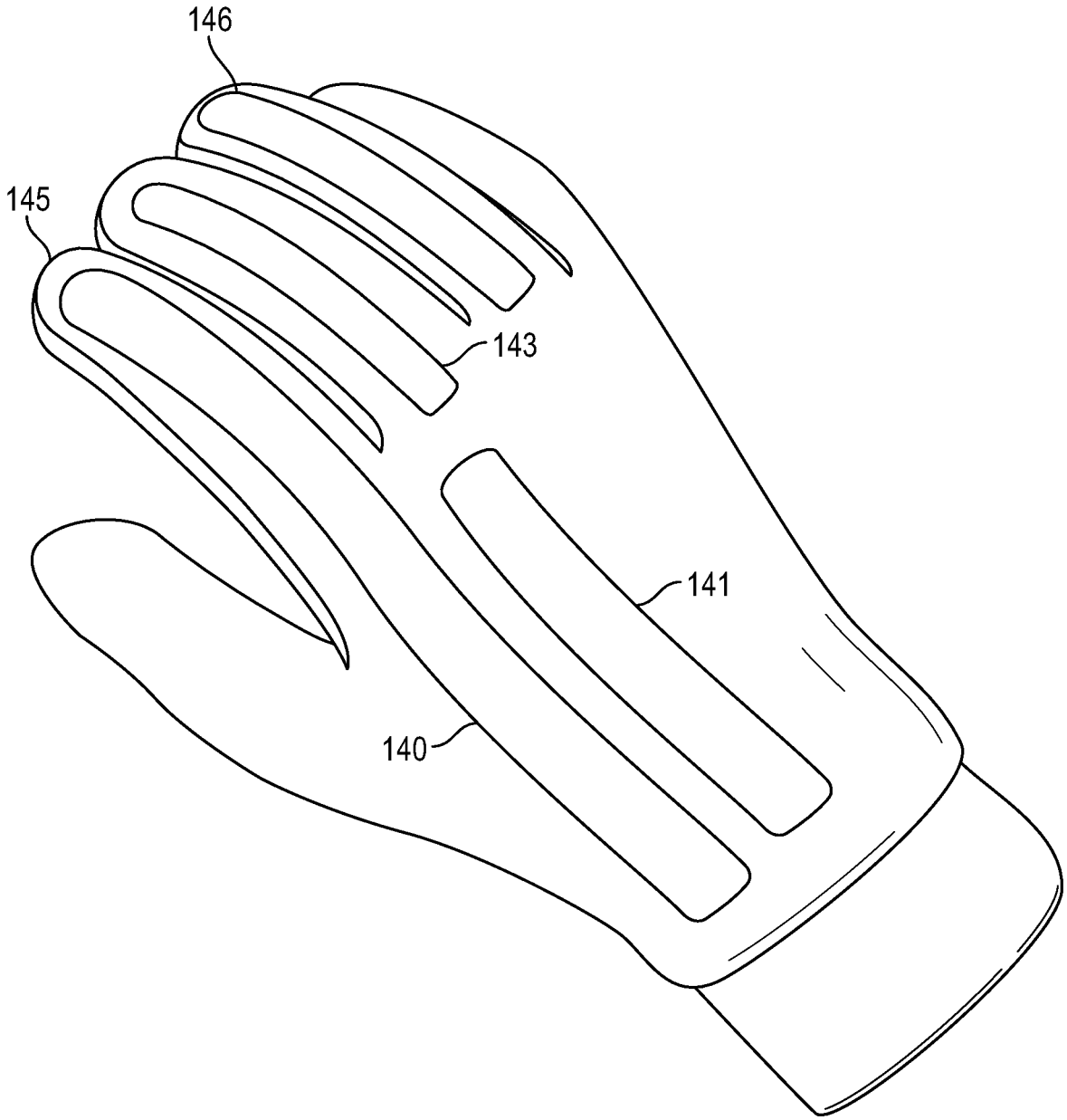
FIG. 14 illustrates various designs applicable for use on a digit, dorsal, or palmar region.

FIG. 14 illustrates embodiments which may be used individually or in any combination and not just on the dorsal region portion but also alternatively on the palmar region as well. One embodiment may employ a dorsal portion 141 which may be aligned with an underlying bone. Another embodiment may employ a long dorsal and digit portion 140 which may be aligned with the underlying bones. Another embodiment may employ a long digit portion 143 which may cover a substantial portion of the digit, but not reach to the tip region 145. Another embodiment may employ a long digit portion which reaches to nearly the end of the digit 146 while another embodiment may continue the long digit portion over a portion of the end of a digit and another embodiment may continue over the end of a digit and curve downward to help protect tip region 145 of a digit. Other embodiments may employ dorsal, dorsal and digit, and/or digit portions individually or in combination with other portions which may be connected in various ways or not. Although not illustrated in FIG. 14, it is understood that such portions may be employed on any part of the thumb and/or the related dorsal region.

Figure 15:
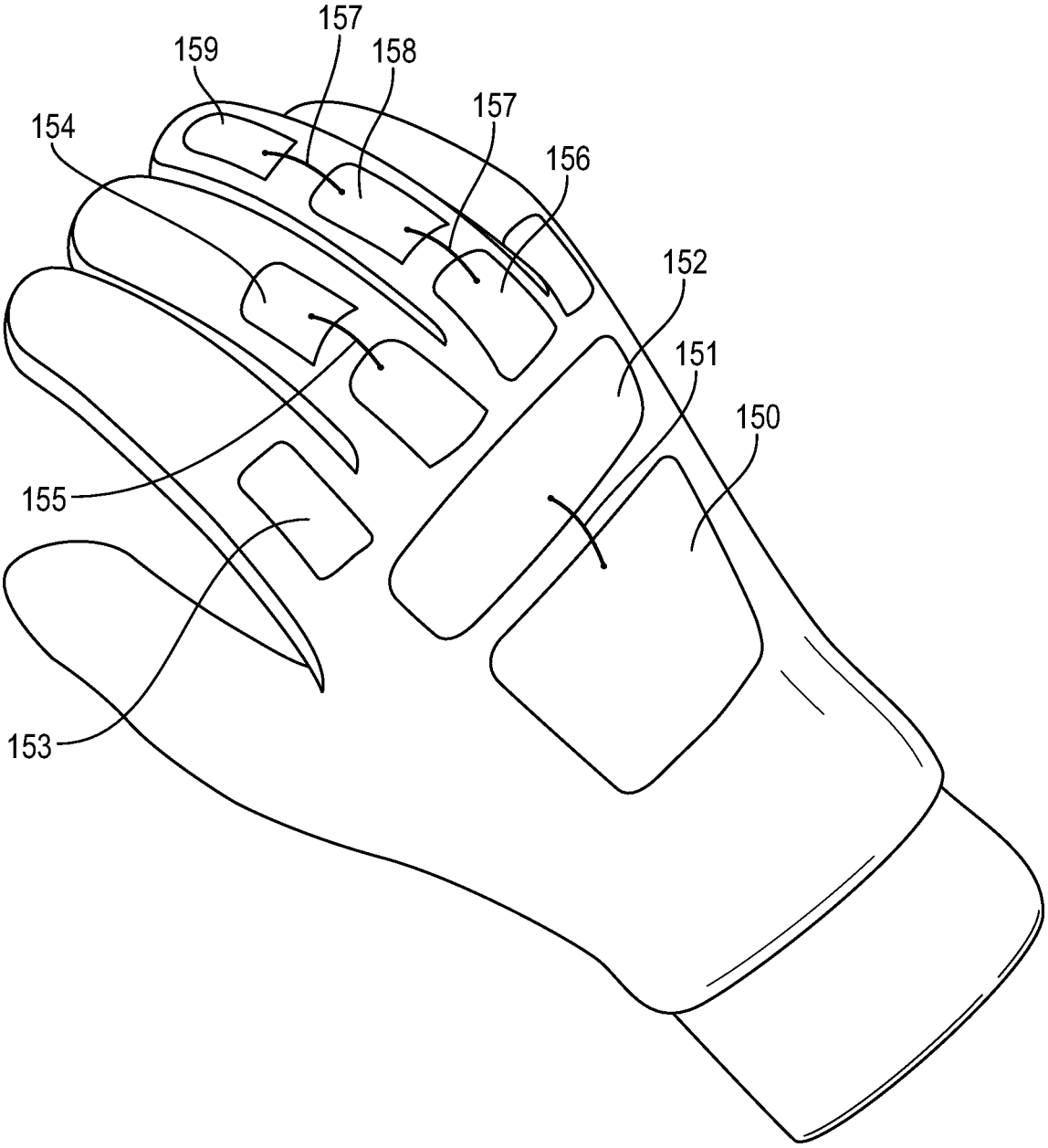
FIG. 15 illustrates protective portions connected in various ways.

FIG. 15 illustrates a perspective view of an embodiment with a first dorsal region portion 150. Another embodiment may include a second dorsal region portion 152 and yet another embodiment may include a connection 151 between at least a first 150 and second dorsal region portions 152. FIG. 15 also illustrates embodiments which may be used individually or in any combination and not just on the dorsal region portion but also alternatively on the palmar region as well. Proximate phalanx portion 153 may be used individually in one embodiment or, in another embodiment, may be used in combination with a middle phalanx portion 154 or, in another embodiment, may be used in combination with a distal phalanx portion 159. These various portions may be connected in some way, either together with a connection 155, or in combination with a connection 157. One embodiment may employ a proximate phalanx portion 156 with a connection 157 to middle phalanx portion 158 with a connection 157 to distal phalanx portion 159. Another embodiment may employ a dorsal region portion 152 connected to any or all of the phalanx portions 159, 158, or 156.

Figure 16:
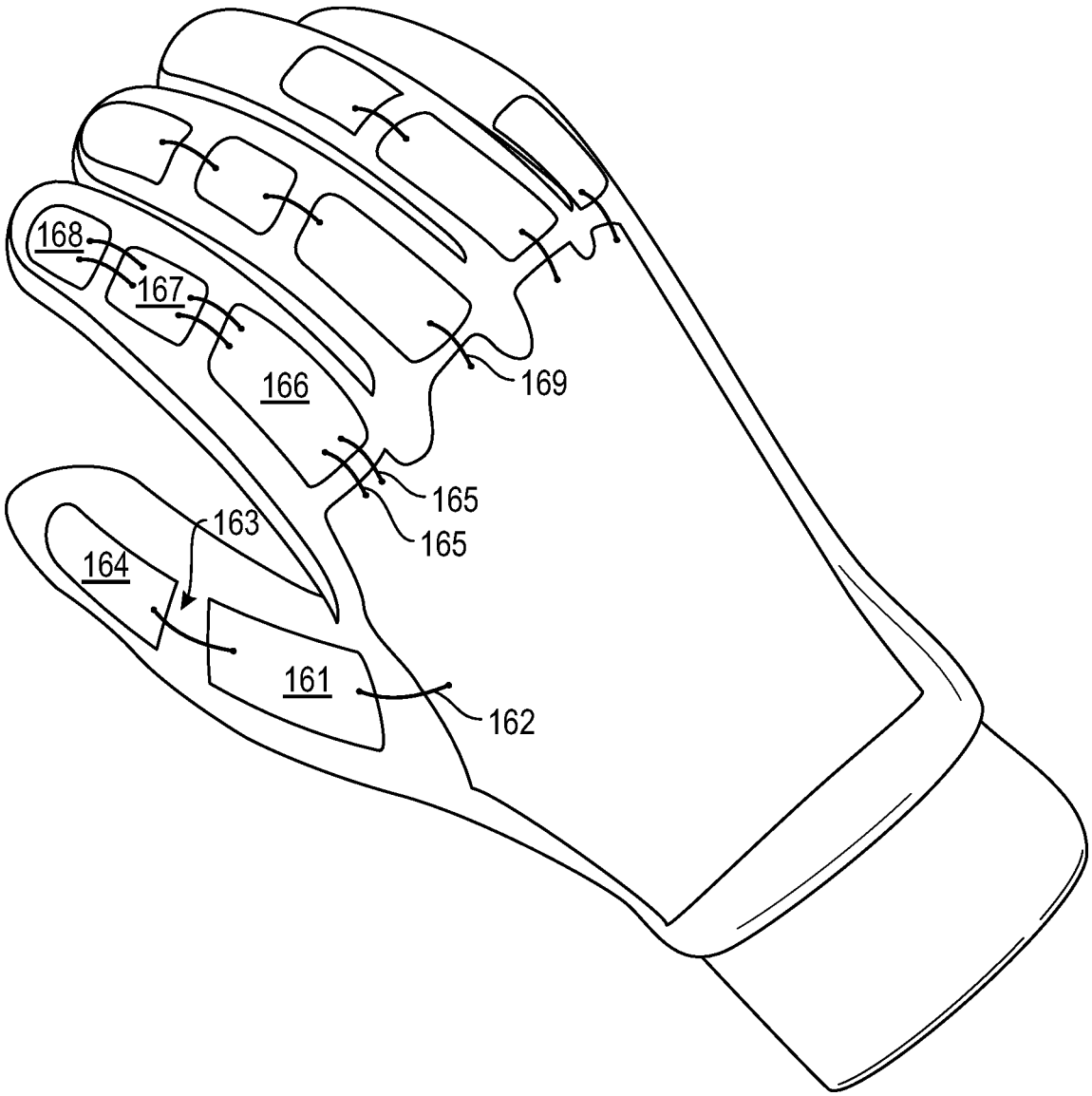
FIG. 16 illustrates protective portions for the digits and dorsal regions and connected in various ways.

FIG. 16 illustrates a perspective view of an embodiment with a dorsal region portion connected in various ways to digit protective portions. In one embodiment, a dorsal region portion may employ connections 165 to connect to a proximate phalanx portion 166 which in turn is connected to middle phalanx portion 167 which in turn is connected to distal phalanx portion 168. In another embodiment a dorsal region portion employs a connection 162 to connect to a proximate phalanx portion 161, which in turn employs connection 163 to connect another phalanx portion 164. FIG. 16 also illustrates embodiments which employ combinations of phalanx portions connected in various ways.

Figure 17:
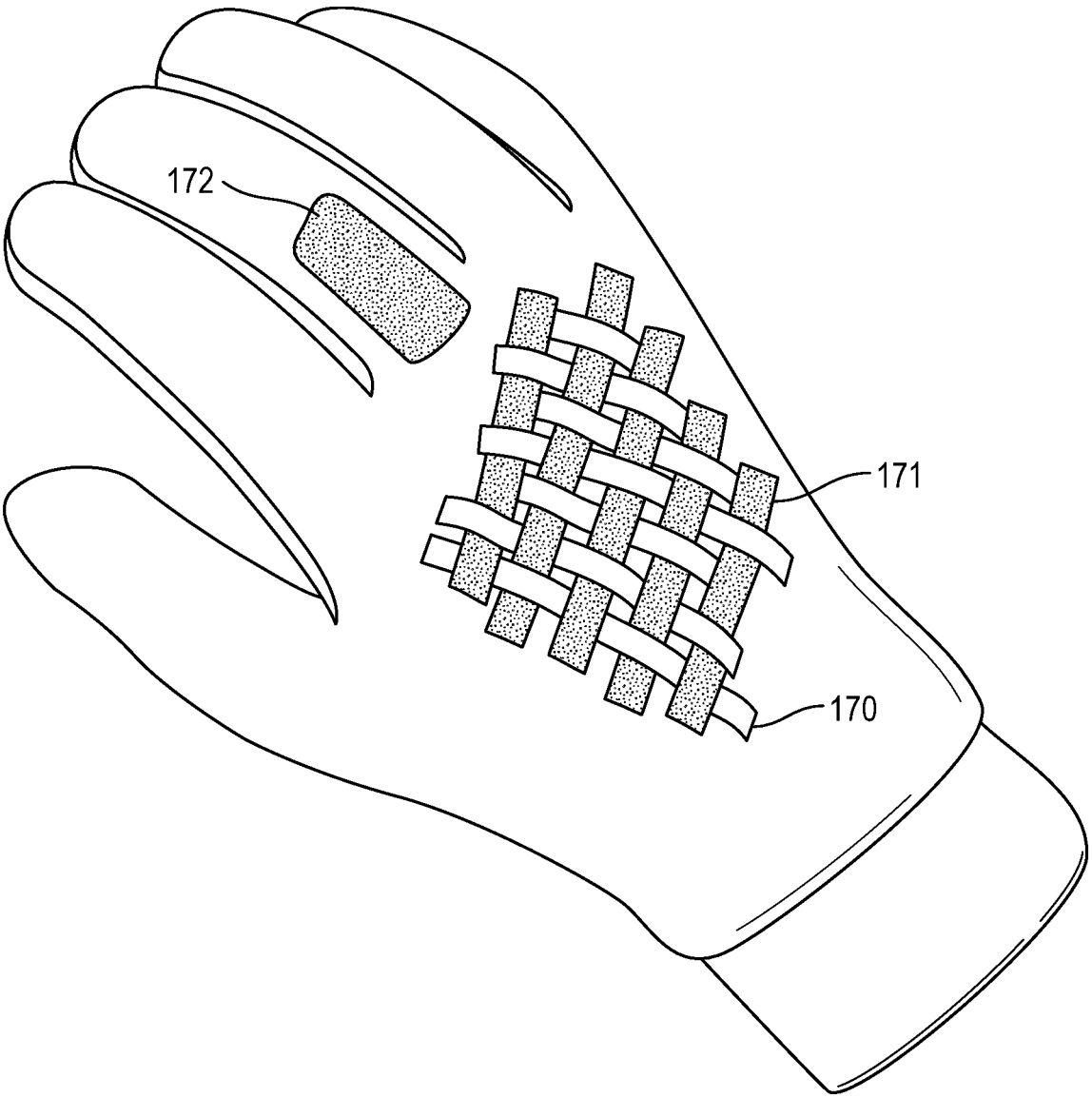
FIG. 17 illustrates protective portions in the form of one or more materials joined together to form a protective portion.

FIG. 17 illustrates an embodiment with a dorsal region portion which employs the weaving or use of one or more materials together. One embodiment shows a first material 170 connected in a woven fashion with a second material 171. Another embodiment may employ the same material as the first 170 and second 171 materials. In another embodiment, the protective portion may be employed on at least a portion of a digit as shown by area 172, while other embodiments may encase a digit, including on the sides, or alternatively to and even over the end of a digit. Another embodiment may employ the woven protective portion over multiple digits with or without a dorsal region being connected. Yet another embodiment may use a first material and a second material joined, attached, co-molded, or pieced together to form a dorsal region and/or digit portion.

Figure 18:
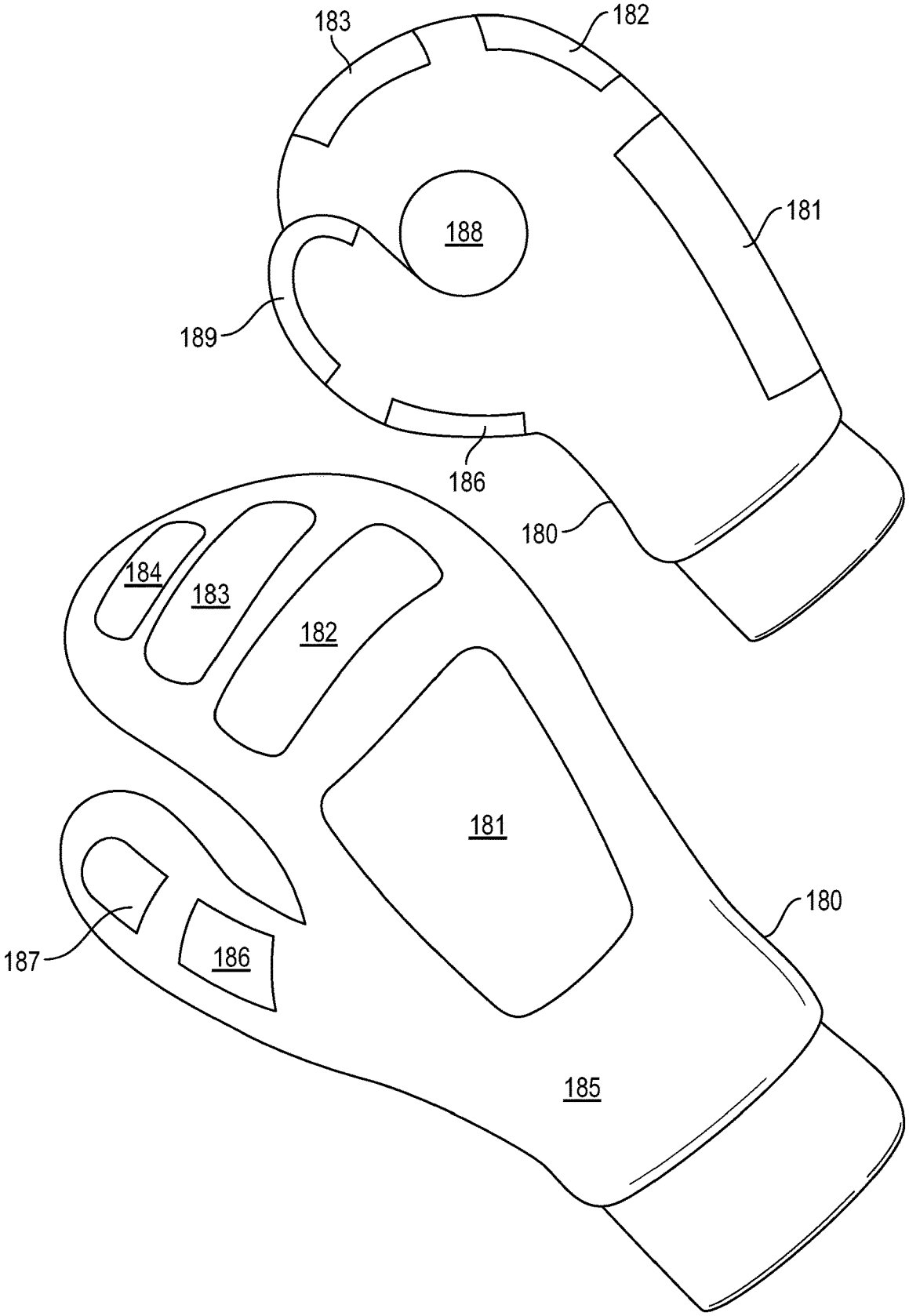
FIG. 18 illustrates a reinforced hand protector where one or more fingers enjoy protection together.

FIG. 18 illustrates an embodiment with a main body 180 which may allow one to place a hand around an area, which may include a shaft 188. In one embodiment the main body may have one or more of the following reinforcement or protective portions over one or more of at least a part of the identified part of a hand, dorsal portion 181, proximate phalanx portion 182, middle phalanx portion 183, distal phalanx portion 184, proximate portion 186, phalanx portion 187. In one embodiment, a dorsal portion 181 employs a size foregoing more area 185 of the main body 180. This area 185 may reach over the wrist and even up the forearm, and dorsal portion may also be employed into that area. Some embodiments may cover a portion of a digit and/or a dorsal region and/or palm, while others may employ a digit or dorsal or palm portion which wraps around or over the end or sides of the digit or dorsal or palm region. One such embodiment can be seen with at least phalanx portion 189 in FIG. 18, while proximate phalanx portion 182 and middle phalanx portion 183 also indicate curvature in the perspective view in FIG. 18. While the illustration in FIG. 18 shows all four fingers in one combined space under the various phalanx portions, it is understood and appreciated that another embodiment may have one or more digits separated into one or more combined spaces. Put differently, one embodiment may preferably have a forefinger and the three remaining fingers in two separate compartments; much like a shooting glove which allows for use of a forefinger separately while keeping the three other fingers together in one compartment.

Figure 19:
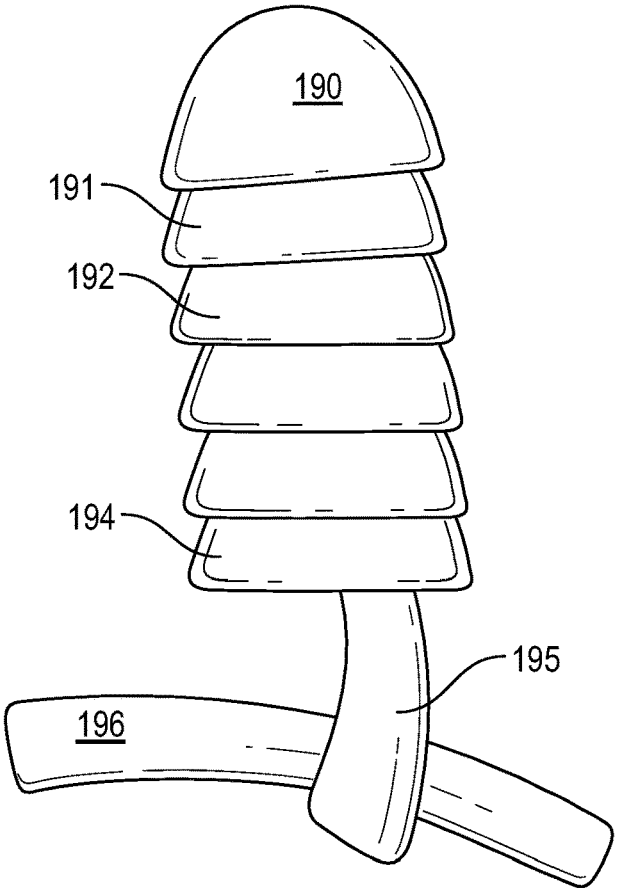
FIGS. 19 and 20 illustrate reinforcement or protective digit portions which may be employed inside, outside, or within a hand protective device such as a glove.
Figure 20:
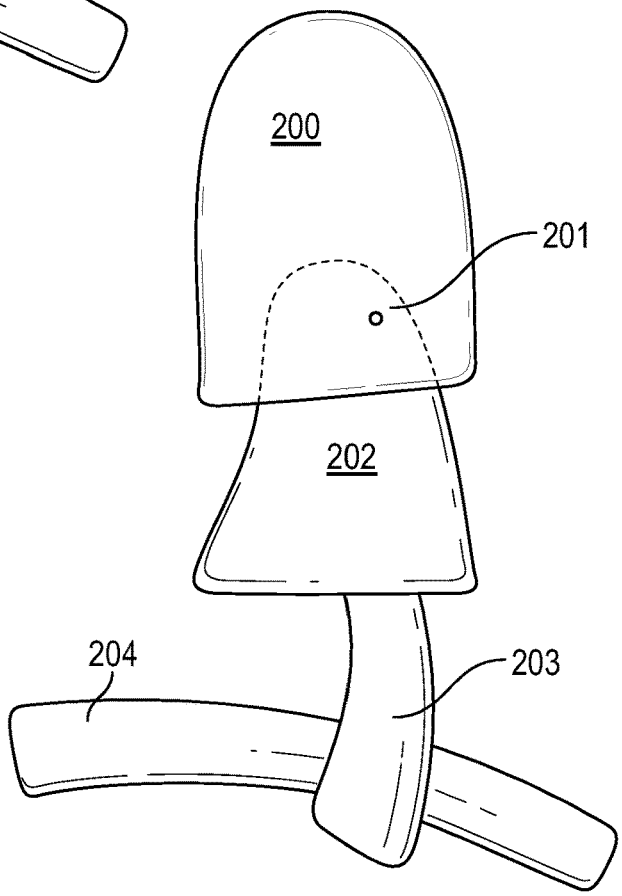

FIGS. 19 and 20 illustrate reinforcement or protective digit portions which may be employed inside, within, or outside a main body or glove. One embodiment may have connecting portion 195 connecting to the exterior or interior of a glove. Another embodiment may have connection portion 196 wrap at least partially around or near the base of a digit or joint. Tip portion 190 may be connected to second portion 191 which may, in turn, be connected to third portion 192 and so on. The connections between these portions can be done in many ways including, but not limited to, mechanical, fabric, adhesive, hook and loop, pressure fit, interlocking portions, connectors and other attachments. Lowermost portion 194 may serve as the opposite end of the reinforcement or protective portion. Tip portion 190 may receive a force, in the form of a ball or puck, and pass that force to the connected portions such as second portion 191 and third portion 192 and may eventually reach lowermost portion 194. In one embodiment a digit may be surrounded by tip 190, while in another embodiment a digit may be surrounded by tip 190 and one or more portions below tip 190. In another embodiment, a digit may be partially surrounded by tip 190 and/or one or more portions below tip 190. Although illustrated as rounded, the portions may take many shapes. Other embodiments may include portions such as tip portion 190, second portion 191, and lowermost portion 194 with at least a section removed from a portion to add in lowering the weight, allowing better airflow, creating or promoting a logo or design, or for aesthetics.

FIG. 20 illustrates a tip portion 200 with a second portion 202 and a connection 201 between them. The connection 201 can take many forms and be in any preferable position to allow for tip portion 200 to move favorably with regard to second portion 202. For example, a non-exhaustive list of connections includes, but is not limited to, a point connection, hinge, wire, rivet, fabric, leather, bolt, screw, and a substantially inelastic means. One embodiment may have connecting portion 203 connecting to the exterior or interior of a glove. Another embodiment may have connection portion 204 wrap at least partially around or near the base of a digit or joint. One embodiment may employ a tip portion 200 with a connection portion 203, without a second portion 202. Although illustrated as rounded, the various portions may take many shapes. Other embodiments may include portions such as tip portion 200 and/or second portion 202 with at least a section removed.

Figure 21C:
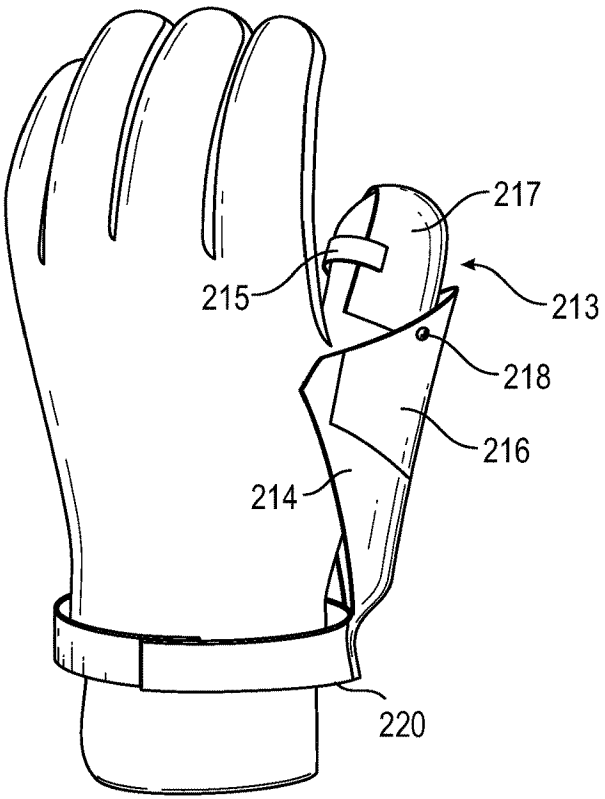
FIGS. 21A-C illustrate reinforcement or protective digit portions which may connected around a wrist or forearm and be employed inside, outside, or within a hand protective device such as a glove.
Figure 21B:
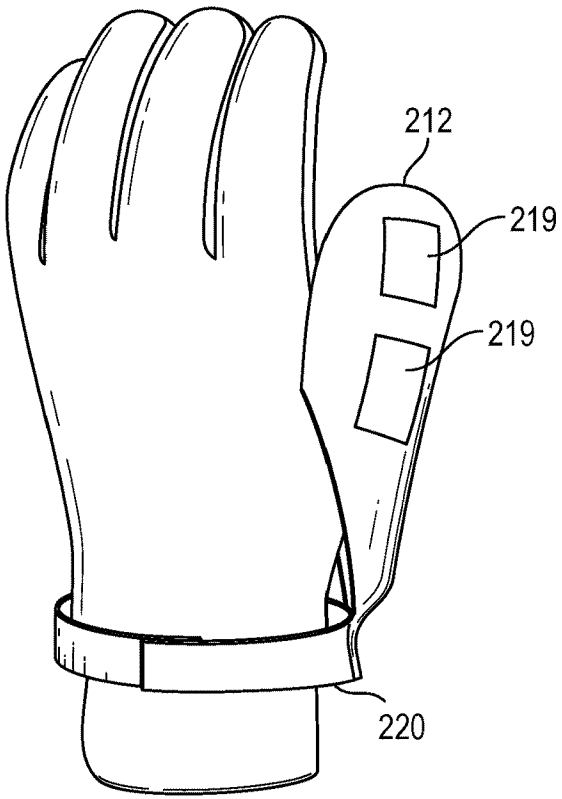
Figure 21A:
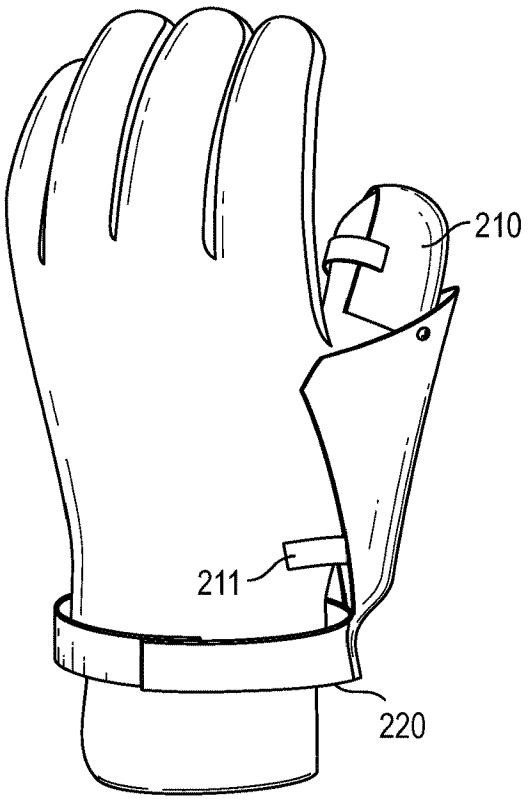

FIG. 21A illustrates a main body with a digit protective portion 210 with an attachment. In one embodiment a digit protective portion 210 may slide over at least a portion of digit and connect directly by a connection within the portion 210, such as a hook and loop fastener. In another embodiment, the attachment may be made by a connection not within the portion, as shown on the upper thumb in FIG. 21A. In another embodiment, a digit protective portion 210 may employ an attachment such as attachment 211, alone or in combination with other attachments. Attachment 211 may employ a hook and loop fabric with a corresponding connecting portion of hook and loop material mounted on the main body. Attachment 211 may alternatively employ an adhesive, connection, or mechanical attachment means. In another embodiment, a connection portion 220 may wrap around a wrist or forearm as shown in FIGS. 21A, 21B, and 21C and in another embodiment, partially around a wrist, forearm, or hand. FIG. 21B illustrates a digit protective portion 212 with reinforcing portions 219. Although illustrated as a single piece, digit protective portion 212 is understood to alternatively employ two or more connected sections. FIG. 21C illustrates a digit protective portion 213 with a tip portion 217, a connection 218, a lower portion 216, and an alternative, additional protective portion 214 which may be separate and removable from lower portion 216. One embodiment may include a connection portion 215 which may connect tip portion 217 to itself or alternatively connect to the main body or both.

Figure 22A:
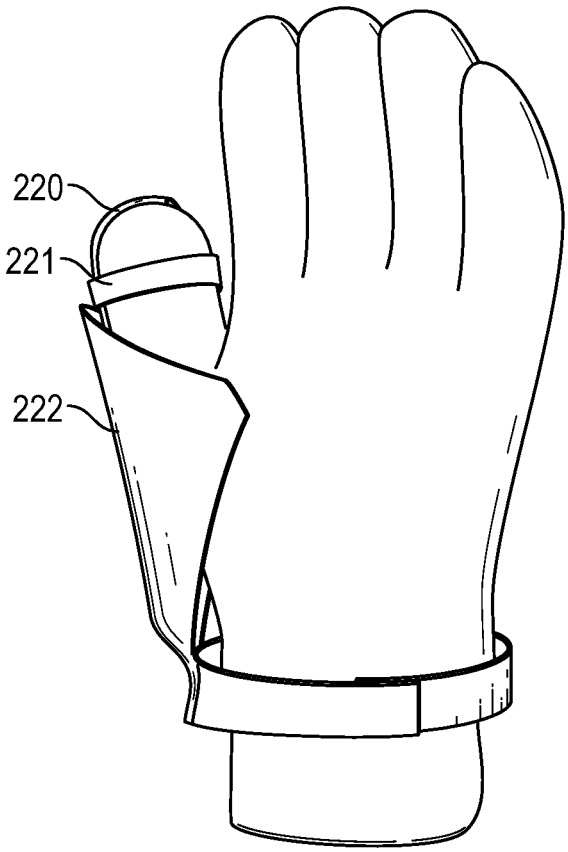
FIGS. 22A-B illustrate reinforcement or protective digit portions with various connections.
Figure 22B:
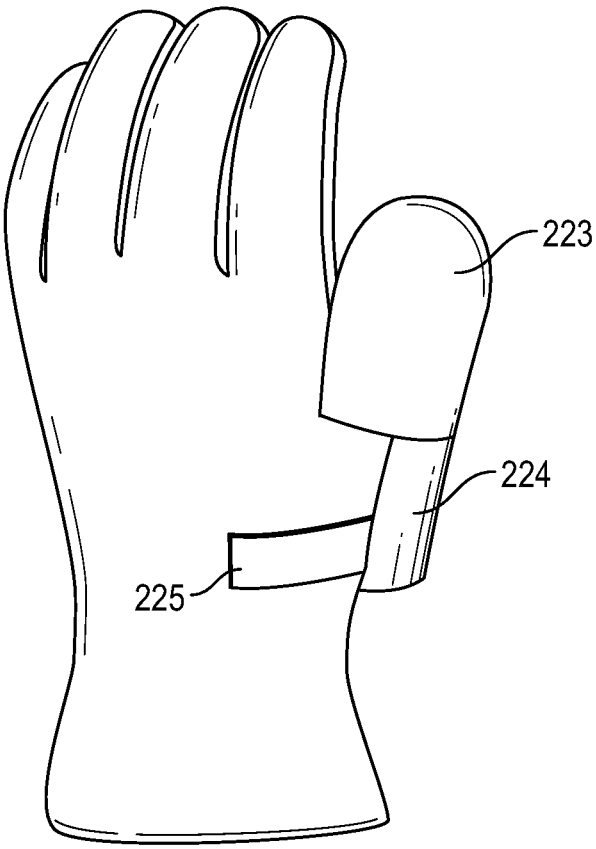

FIG. 22A illustrates a palmar perspective view of another embodiment of a digit protection portion 220, this one covering at least a portion of the end of a digit. In one embodiment, the digit protection portion 220 may be connected by connection portion 221. In another embodiment, the digit protection portion 220 may be connected to lower portion 222 or not connected. FIG. 22B illustrates a dorsal perspective view of another embodiment of a digit protection device with an upper portion 223 and a lower portion 224, which may be one or more pieces and one or more materials. Another embodiment includes a connection 225 which may assist in securing the digit protection device.

Figure 23:
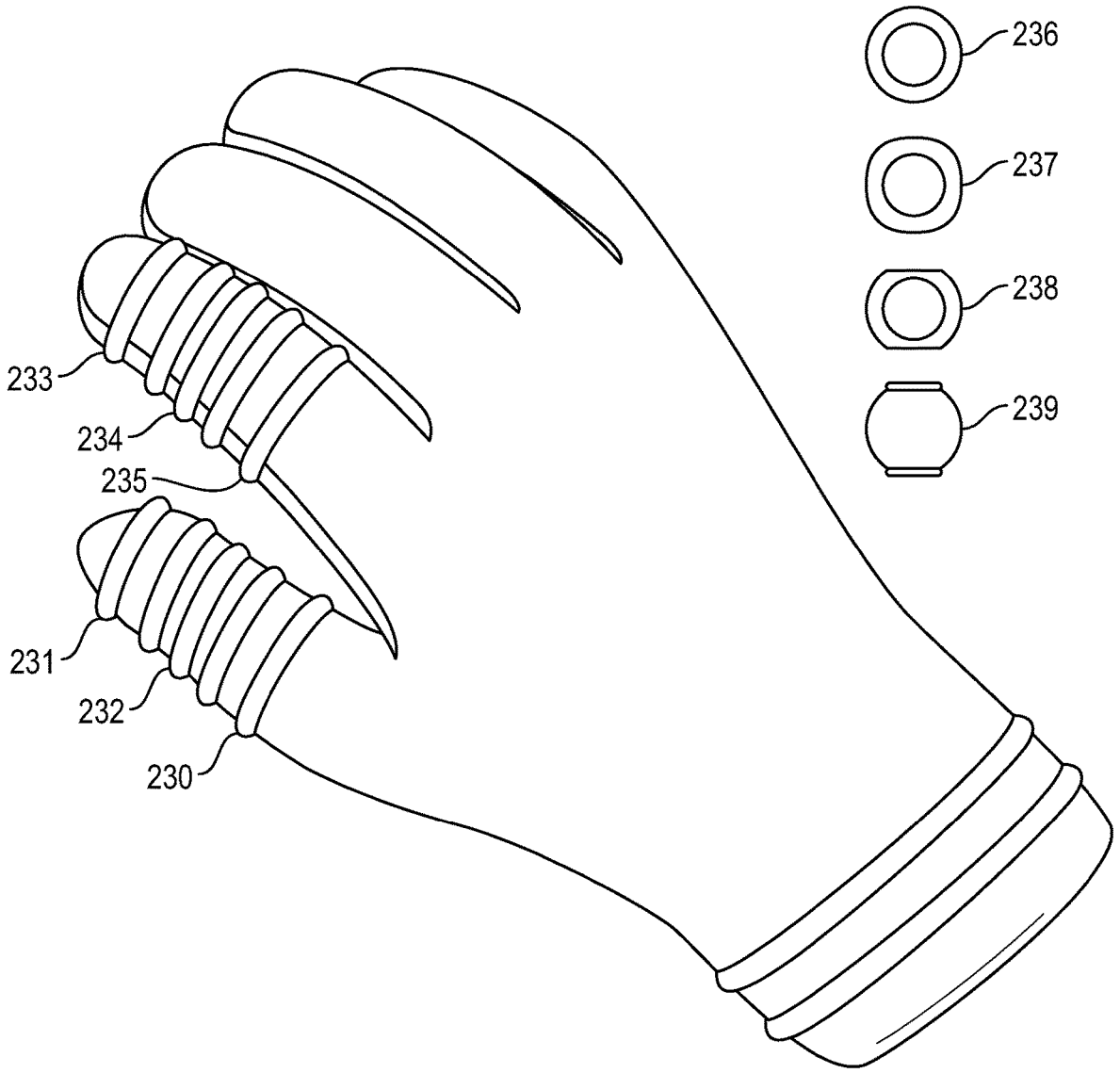
FIG. 23 illustrates reinforcement or protective hand portions with ring-like portions.

FIG. 23 illustrates a reinforced hand protector with various ring-like portions employed. In one embodiment, distal ring-like portion 233, middle ring-like portion 234, and proximate ring-like portion 235 may be employed on one or more digits, individually, together, or in combination with other protective or reinforced devices disclosed above. In another embodiment, distal ring-like portion 231, middle ring-like portion 232, and proximate ring-like portion 230 may be employed on one or more digits, together with one or more ring-like portion on another digit. A ring-like portion may take various shapes, such as a substantially circular ring 236, a ring with one or more substantially flattened sides 237, a ring with substantially flattened upper and lower sides 238, and a substantially circular ring with somewhat thinner sides 239.

Figure 24:
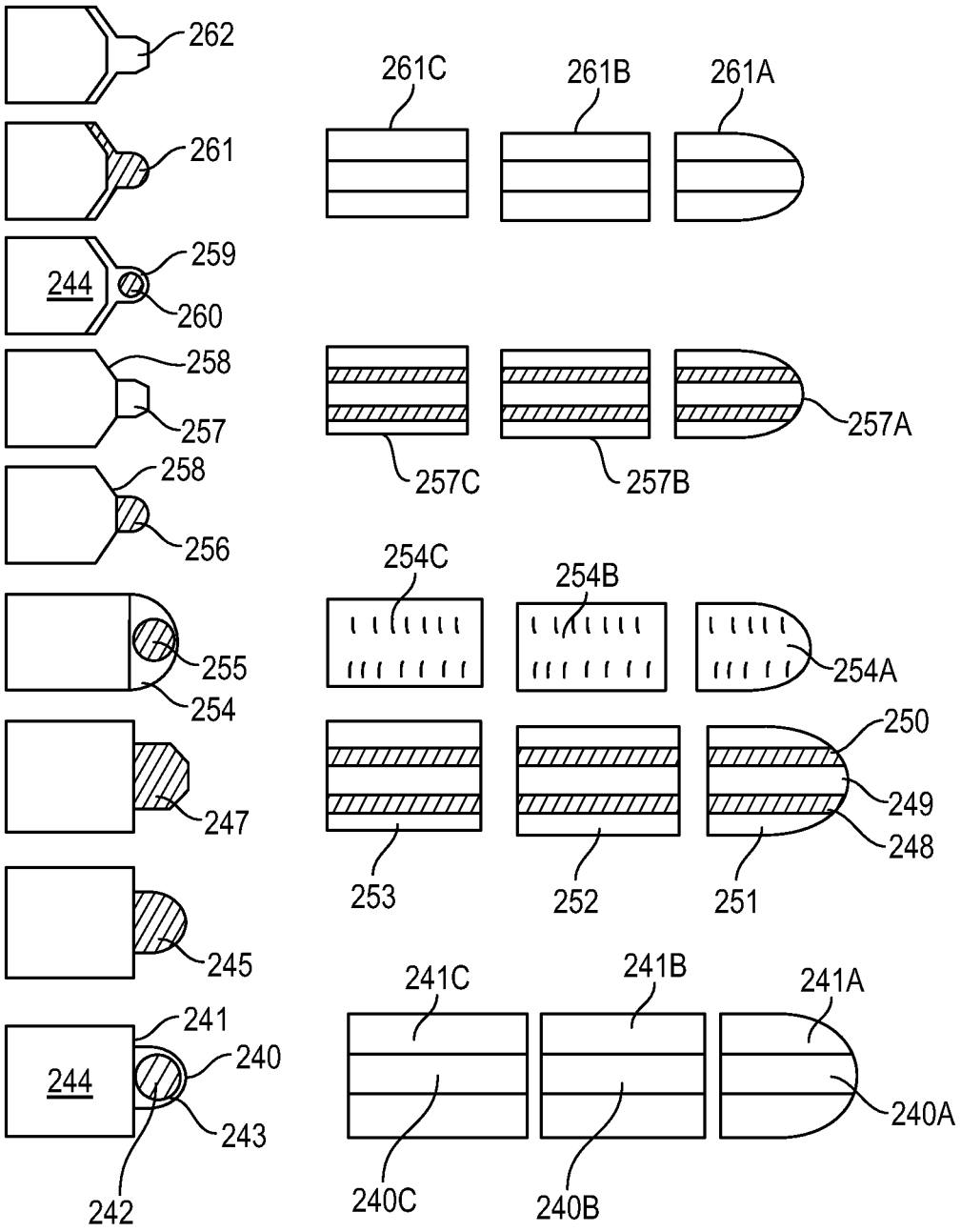
FIG. 24 illustrates various reinforcement or protective digit portions and designs.

FIG. 24 illustrates various digit protective designs. Raised portion 240 may be employed on one or more digit protection portions as shown with 240A-C on base 244. In this embodiment, the raised portion 240 is rounded and may include separate pieces, such as covering 243 and round portion 242, or it may be a more singular piece 245. Another embodiment employs a multi-sided portion 247 which may be employed on the proximate 253, middle 252, or distal 251 portion of a digit protection portion or in any combination. In this multi-sided design, a topmost portion 249 may have adjacent sides 250 and 248. A rounded portion 255 may employ a covering 254 which extends beyond the rounded portion 255. This embodiment may be easier to manufacture and may appear smoother or less complicated, as shown with 254A-C. A base 244 may also be modified to be a less solid chamber 258. Another embodiment employs a more solid and partially rounded raised portion 256, while another embodiment employs a somewhat hollow or less solid raised portion 257 along with a modified base 258. This embodiment may be employed on the proximate 257C, middle 257B, or distal 257A portion of a digit protection portion or in any combination, including with other raised portions. Another embodiment employs a two part raised portion with an exterior 259 and interior 260 and alternatively, with a correspondingly shaped base 244. Another embodiment employs a more singular raised portion 261 and such raised portion may extend the length of a digit, 261A-C, which could, of course, include a finger or a thumb. Another embodiment employs a somewhat hollow or less solid raised portion 262 with a modified base.

As described and illustrated here, any connection between two or more reinforcement and/or protective devices or portions may be made in many ways and will be apparent to those skilled in the art. For example, and not by way of limitation, such a connection could be made with wire, cable, hinge, fabric, plastic, rubber, string, leather, foam rubber, rope, metal, a substantially inextensible but pliable means, and the formation of any pliable attachment between the two.

In some embodiments, a first, second, and additional materials are mentioned. The materials may have different properties. For example, in some embodiments, the first material may have glossy characteristics, while the second material may have matte characteristics. In other embodiments, the converse may be true. In some embodiments, the first material and the second material may be different densities, strengths, weights, thicknesses, size, or shapes. In various embodiments, one or more materials may be embedded or combined with a first material and the second material may be used for aesthetic or functional purposes. For example, different portions may be made from different materials, which may be molded or otherwise assembled or otherwise secured to the second material and/or additional materials. In an embodiment, the second material and the first material may be secured to each other through a bond (e.g., as in the molding process) or through adhesion (e.g., via an adhesive) or even by fit, manufacturing, weaving, heat, or hook and loop material.

The various reinforcement and/or protective devices and portions which are illustrated in the various figures and described in this specification may be employed against a hand, on the exterior of a hand protective device, or anywhere in between and within a hand protective device, glove, or portion of a glove. For example, one embodiment may use an interior glove, with an inner layer of foam, a reinforcement and/or protective device or portion as described herein, and then an exterior glove like assembly. Layers can be intermixed and/or intermingled within a hand protective device and so too can the reinforcement and/or protective devices portions chosen to be included.

Although to the extent that specific advantages have been enumerated above, various embodiments may include some, none, or all of the enumerated or disclosed advantages. Other technical advantages may become readily apparent to one of ordinary skill in the art after review of the figures and description provided herein.

Modifications, additions, or omissions may be made to the systems, apparatuses, designs, and methods described herein without departing from the scope of the disclosure. For example, the portions and connections and protective devices may be integrated or separated. Moreover, the operations disclosed herein may be performed by more, fewer, or other components and the methods described may include more, fewer, or other steps. Additionally, steps may be performed in any suitable order.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim and notation is made in the remarks of any related amendment.

While the principles have been made clear in the illustrative embodiments and descriptions set forth above, it will be apparent to those skilled in the art that various modifications may be made to the structure, arrangement, proportion, elements, materials, and components used in the practice of the invention.

The foregoing embodiments have been shown and described for the purpose of illustrating the functional and structural principles of this invention and are subject to change without departure from such principles. Therefore, this invention includes all modifications encompassed within the spirit and scope of this disclosure, as recited in the following claims.

What is claimed is:

1. A hand protector comprising:

a main body including a palmar side and a dorsal side;

at least one digit portion having a first and second digit protecting portion;

where the first digit protecting portion is connected to the main body;

the first and second digit protecting portions are connected to each other;

at least one of the two digit protecting portions is constructed to wrap at least partially around a portion of a digit; and has a cross sectional shape with opposing side walls for positioning on opposing sides of a digit and a side wall having a foot angled at an end thereof and the foot further having an upturned portion.

2. The hand protector as in claim 1, wherein:

the first digit protecting portion is a proximate phalanx portion and the second digit protecting portion is a middle phalanx section.

3. The hand protector as in claim 1, wherein:

the at least one digit portion has a third digit protecting portion.

4. The hand protector as in claim 3, wherein:

the third digit protecting portion is connected to the second digit protecting portion.

5. The hand protector as in claim 4, wherein:

the third digit protecting portion is a distal phalanx portion.

6. The hand protector as in claim 5, wherein:

the main body has a knuckle protector.

7. The hand protector as in claim 4, wherein the third digit protecting portion is configured to extends over at least a portion of the end of a digit.

8. The hand protector as in claim 4, wherein the first digit protecting portion is configured to curves around at least a portion of the end of a digit.

9. The hand protector as in claim 1, wherein:

the main body has a dorsal protecting portion.

10. The hand protector as in claim 1, wherein:

the first and second digit protecting portions are hinged together.

11. The hand protector as in claim 1, wherein:

the first and second digit protecting portions are hinged together on the sides of the corresponding digit.

12. The hand protector as in claim 1, further comprising:

a second digit portion having a digit protecting portion constructed to wrap at least partially around a portion of a digit and having a cross sectional shape with opposing side walls for positioning on opposing sides of a digit and a side wall having a foot at an end thereof and the foot having an upturned portion.

13. The hand protector as in claim 12, wherein:

the first and second digit portions are each constructed to wrap at least partially around a portion of two adjacent digits.

14. The hand protector as in claim 1, wherein:

the first and second digit protecting portions have a cross sectional shape which is one of the following: substantially curved, substantially square, substantially rectangular, substantially multisided, or substantially multicurved.

15. The hand protector as in claim 1, wherein:

at least part of the upturned portion is angled towards the side wall.

* * * * *